US012514314B2

(12) United States Patent
Kim

(10) Patent No.: US 12,514,314 B2
(45) Date of Patent: Jan. 6, 2026

(54) KNIT GOAL KEEPER GLOVE

(71) Applicant: NIKE, Inc., Beaverton, OR (US)

(72) Inventor: George S. Kim, Wilsonville, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/678,064

(22) Filed: May 30, 2024

(65) Prior Publication Data

US 2025/0366549 A1 Dec. 4, 2025

(51) Int. Cl.
*A41D 19/015* (2006.01)
*A63B 71/14* (2006.01)

(52) U.S. Cl.
CPC ..... *A41D 19/01547* (2013.01); *A63B 71/148* (2013.01); *A63B 2243/0025* (2013.01)

(58) Field of Classification Search
CPC ..... A41D 19/01547; A41D 19/01558; A41D 19/01564; A41D 19/0006; A41D 2400/80
USPC ..... 2/161.1, 161.8, 167, 159
See application file for complete search history.

(56) References Cited

U.S. PATENT DOCUMENTS 6,990,689 B1 * 1/2006 Thellmann ..... A63B 71/148 2/161.1
7,607,178 B2 * 10/2009 DeBlasis ..... A63B 71/148 2/21
8,726,418 B2 * 5/2014 DeBlasis ..... A41F 1/06 2/161.1
2007/0022513 A1 * 2/2007 Avis ..... A41D 19/01523 2/169
2008/0120754 A1 * 5/2008 Raymond ..... A41D 19/01558 2/167
2009/0126074 A1 * 5/2009 Mattesky ..... A41D 19/01523 2/167
2012/0159681 A1 * 6/2012 Gibby ..... A41D 19/001 2/20
2013/0333093 A1 * 12/2013 Storelli ..... A63B 71/148 2/161.1
2014/0059739 A1 * 3/2014 Gellis ..... A41D 19/0048 2/168

(Continued)

FOREIGN PATENT DOCUMENTS

KR 102545855 B1 * 6/2023 ..... A41D 19/01576

OTHER PUBLICATIONS

English machine translation of KR 102545855 B1. Via Clarivate Analytics performed on PE2E Search. Translation performed on May 23, 2025. (Year: 2023).*

*Primary Examiner* — Jameson D Collier
(74) *Attorney, Agent, or Firm* — Shook, Hardy & Bacon L.L.P.

(57) ABSTRACT

Athletic gloves, such as a goalkeeper's glove include a distal dorsal portion. The distal dorsal portion includes a multi-layer construction, such as a three-layer construction, including a textile layer, which sits next or at least closer to a wearer's skin, a medial layer, which may be made of foam, such as a polymeric foam composition, and an outer knit textile layer. The outer knit textile layer may include a first yarn having a first core yarn and a first polymeric composition coating. The knit textile layer is thermoformed in an example to form a high-grip portion on the distal dorsal portion of the athletic glove. The medial layer may include ridges on an exterior surface of the medial layer. These ridges may further be visible on an external surface of the distal dorsal portion of the glove.

14 Claims, 7 Drawing Sheets

(56) References Cited

U.S. PATENT DOCUMENTS

| | | | | |
|---|---|---|---|---|
| 2016/0366958 | A1* | 12/2016 | Hochmuth | B32B 5/245 |
| 2016/0375343 | A1* | 12/2016 | Woodhead | A63B 71/143 2/16 |
| 2019/0176014 | A1* | 6/2019 | Chen | A41D 19/01523 |
| 2019/0364997 | A1* | 12/2019 | Chen | B32B 25/10 |
| 2020/0214374 | A1* | 7/2020 | Chen | A41D 19/01558 |
| 2021/0077891 | A1* | 3/2021 | Pechtold | A63B 71/148 |
| 2021/0145093 | A1* | 5/2021 | Blunt | A41D 19/01523 |
| 2022/0395742 | A1* | 12/2022 | Rodriguez-Garcia | A41D 19/0006 |
| 2023/0008444 | A1* | 1/2023 | Boehme | A41D 19/01564 |
| 2023/0390629 | A1* | 12/2023 | Boehme | A63B 71/148 |

* cited by examiner

KNIT GOAL KEEPER GLOVE

TECHNICAL FIELD

Aspects hereof relate to an athletic glove, such as a glove for use by a goal keeper in the game of global football, hereinafter referred to as "soccer."

BACKGROUND

Soccer goal keepers ("goalies") wear specialized gloves while playing soccer to increase their chances of defending the goal. The palmar surface of these gloves is often made of a sticky material designed to maximize grip in various weather conditions. This helps goalies effectively catch and secure the ball during play. In addition to catching the ball to defend the goal, goalies sometimes defend their team's goal by punching the ball away from the goal. This technique is useful when the goal area is crowded, during corner kicks, or to deflect passes that are played across the field toward the goal, where catching the ball might be difficult or risky.

Punching the ball allows the goalie to clear the ball away from the goal area quickly, reducing the chance of an opponent gaining possession of the ball or scoring. The dorsal surface of a goal keeper's glove is used to make contact with the ball when punching.

SUMMARY

Aspects of the present invention relate to an athletic glove. The glove includes a dorsal side and a palmar side. The dorsal side includes a distal dorsal portion comprising three layers. The outermost knit textile layer comprises a thermoformed network of interlooped yarns comprising a first yarn having a core and a coating, the coating at least partially surrounding the core, and wherein the coating interconnects the thermoformed network of interlooped yarns by surrounding at least a portion of the core and occupying at least a portion of spaces between yarns in the thermoformed network of interlooped yarns. Due at least in part to the material of the first yarn, the exterior knit textile layer may have a coefficient of friction (COF) that is greater than a COF of one or more other areas of the glove. This allows a soccer goal keeper to better control the trajectory and speed of the soccer ball when punching.

A medial layer of the distal dorsal portion of the glove, which may comprise a polymeric foam composition, protects the dorsal side of the goal keeper's hand, in particular the area around their knuckles, when punching the ball by absorbing compressive energy. The medial layer may further include ridges on the exterior surface of the medial layer. The ridges, combined with the grip of the exterior knit surface of the distal dorsal portion of the glove, further provide control and stability when punching the ball. In this way, a goal keeper is better able to direct the ball away from the goal, thereby successfully defending.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

Illustrative aspects hereof are described in detail herein with reference to the attached drawing figures, which hereby are incorporated by reference and wherein.

DETAILED DESCRIPTION

Figure 1:
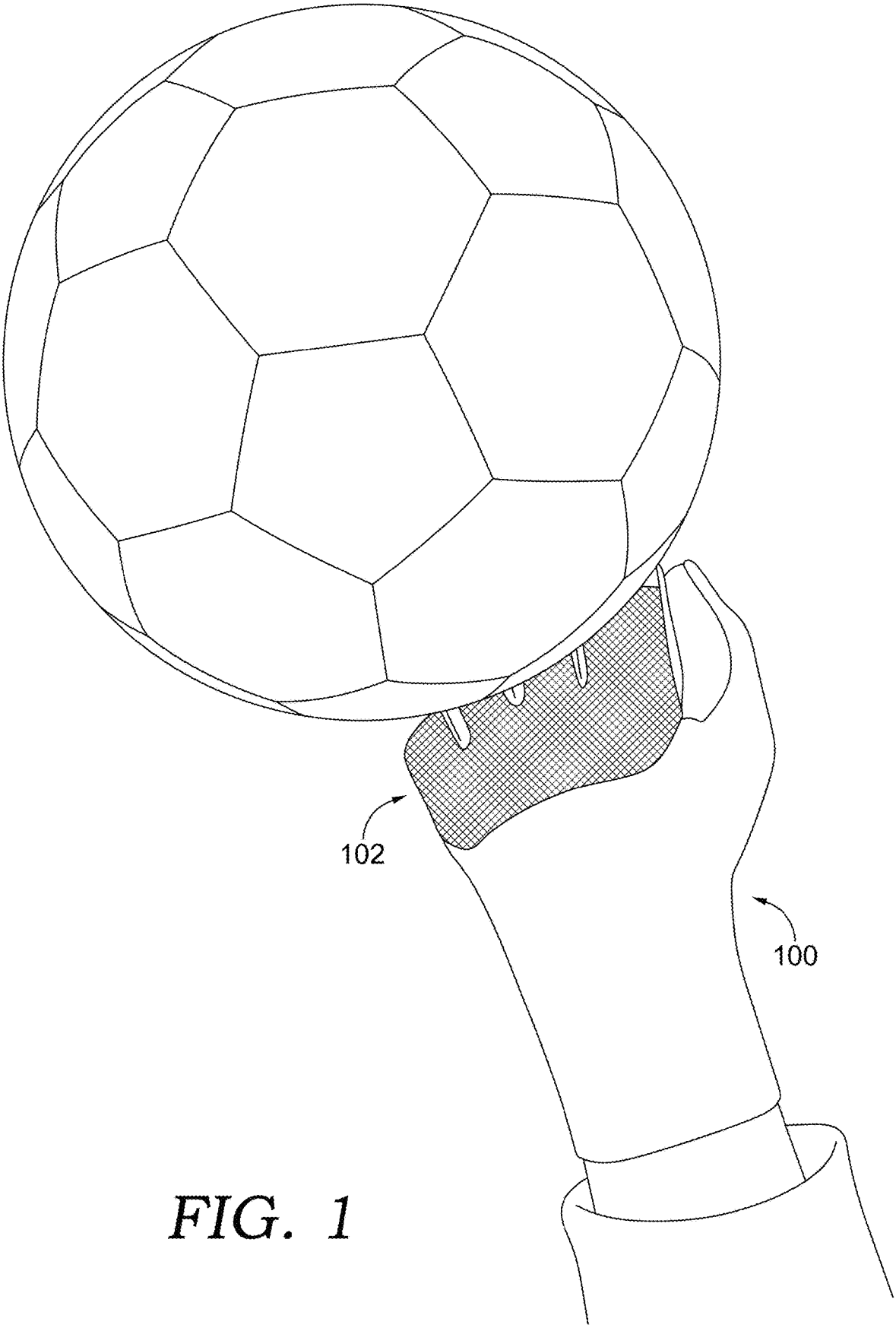
FIG. 1 depicts an athletic glove worn by a soccer goal keeper who is punching a soccer ball in accordance with aspects herein.

The subject matter of aspects of the present invention is described with specificity herein to meet statutory requirements. However, the description itself is not intended to limit the scope of this patent. Rather, the inventors have contemplated that the claimed subject matter might also be embodied in other ways, to include different members, portions, and/or elements similar to the ones described in this document, in conjunction with other present or future technologies.

Goalkeeper gloves are an essential piece of equipment for any soccer goalie, providing not only protection but also enhancing their ability to grip and control the ball. The gloves are designed with padding to absorb the impact of high-speed shots, which helps in reducing the risk of injury to the hands and fingers. This padding can vary in thickness and material, but its primary purpose is to cushion the hands from the force of the ball.

Moreover, the surface of goalie gloves is made from materials that increase friction and grip, allowing for better handling of the ball. This is particularly important in adverse weather conditions, where a wet or slippery ball can be challenging to hold onto. The enhanced grip also aids goalkeepers in catching, throwing, and even punching the ball with more precision and control. In essence, goalie gloves are a crucial tool that supports goalkeepers in performing their best on the field, safeguarding them from injuries and boosting their overall performance.

With specific focus on the dorsal portion of the glove that serves as the punch pad for the goalkeeper glove, the material selection and structure serves multiple purposes for the goalie. A first purpose is to protect the hand of the goalie during contact with the ball during a punching motion. This protection is through energy absorption and force distribution. As will be provided in more detail below, the punch pad portion of the goalkeeper glove is contemplated herein to be formed from a multi-layer construction that enhances the protection of the goal keeper's hand.

A second purpose of the punch pad portion of the goalkeeper glove is to provide enhanced grip through frictional engagement between the punch pad and the ball during a punching action. As introduced above, this increased grip affords enhanced control of the ball and the resulting placement and direction of the ball from the punching action. The enhanced grip is helpful when moisture, such as rain, mist, irrigation, dew, or other sources of wetness may impact the ball and/or the punch pad. As will be provided in greater detail below, aspects contemplated herein include a knit textile forming an outermost surface of the punch pad that is formed from core/sheath yarns that are interlooped and thermoformed. When the knit textile is thermoformed, at least some of a first coating from the sheath may flow and occupy at least a portion of spaces between courses of the interlooped yarn(s).

In this way, it is contemplated that a goalkeepers glove has a punch pad portion on the dorsal side of the glove that provide enhanced grip through a knit textile where the knit textile is thermoformed to cause a flowing of a coating material within spaces of the interlooped yarns forming the knit textile. This structure and additional layers, such as a medial layer disposed within the punch pad portion of the goal keeper glove, provide enhanced force absorption and deflection to protect the goalkeeper's hand. Greater detail follows on the materials, techniques, and structures leveraged to realize these benefits of enhanced grip and enhanced protection.

At a high level, aspects herein are directed to an athletic glove. In a specific non-limiting example the athletic glove of focus herein is for use by a soccer goal keeper or goalie. The glove includes a palmar side and a dorsal side. The dorsal side (e.g., the traditional backside of a glove) has a distal portion and a proximal portion. The distal portion of the dorsal side includes a multi-layer construction, such as a three-layer construction. In this example of a three-layer construction, the first layer is a textile layer, which sits next or at least closer to the wearer's skin. The second layer is a medial layer, which may be made of foam, such as a polymeric foam composition. The third layer, or outer layer, is a knitted textile layer, which may include a first yarn having a first core yarn (also referred to herein as a "core") and a first polymeric composition coating (also referred to herein as a "coating"). In some examples a core and coating yarn is referred to as a core and sheath yarn. The proximal portion of the dorsal side comprises a textile, such as a knit, woven, or non-woven structure. The distal portion of the palmar side includes at least a relatively high grip composition for controlling and grasping a ball. In an example the distal portion of the palmar side includes at least two layers. One layer may be a foam layer. Another layer, the outer-most layer, may be formed of, for example, leather, synthetic leather, or polymeric compositions (e.g., polyurethane) that enhance grip of the glove relative to a ball. The proximal portion of the palmar side comprises a textile, such as the textile of the proximal portion of the dorsal side of the glove.

In example aspects, the exterior knit textile layer of the distal dorsal portion of the glove is created by coating a core yarn that is suitable to be mechanically manipulated with polymeric composition having elastomeric properties. The resulting coated first yarn retains the tenacity and stretch resistance of the core yarn, while also providing an external-facing surface having superior traction or grip and abrasion resistance due to the elastomeric properties of the coating. This provides the glove wearer with enhanced grip, stability, and control when making contact with the ball using the distal dorsal portion of the glove, for example when punching the soccer ball.

Thermoplastic elastomers have been identified that can be incorporated into polymeric compositions to provide levels of abrasion resistance, traction (which may also be referred to as grip), or both, making these materials suitable for use in articles where abrasion resistance or traction are desirable, e.g., articles of apparel, footwear, and sporting equipment. Various aspects of this disclosure are directed to incorporating these thermoplastic elastomers into the knitted textile which forms the outer layer of the distal dorsal portion of the soccer goalie athletic glove in order to maximize certain desired functionality, such as ball control and durability. In many cases, the level of abrasion resistance, traction, or both provided by these polymeric compositions is equivalent to or better than that of standard vulcanized rubber compositions used in the manufacturing of footwear, apparel, and sporting equipment. Unlike vulcanized rubber, due to the thermoplastic nature of these polymeric compositions and their properties in the solid and molten state, it is possible to readily form them into coated yarns that have suitable properties for use in industrial-scale knitting or weaving equipment. These properties result in yarns that can be readily incorporated into various articles, e.g., textiles used in conventional manufacturing processes such as knitting and weaving, as well as industrial-scale processes for making nonwoven textiles. Also, unlike vulcanized rubber, these textiles and articles into which these textiles are incorporated can then, in turn, be thermoformed in a manner that reflows the polymeric composition of the coated yarns and creates an abrasion-resistant or higher-grip surface on the textile or article under conditions that limit damage to other components of the textile or article, such as, for example, other yarns, other textiles, foams, molded resin components, or the like.

In example aspects, the knitted textile which forms the outer layer of the distal dorsal portion of the soccer goalie athletic glove may include a first yarn having a first core yarn (also referred to herein as a "core") and a first coating (also referred to herein as a "coating"). In one aspect, the first yarn may comprise one or more core yarns that may be at least partially coated with a coating, e.g., formed of a grip material. Alternatively, when core yarns are used, each core yarn may form a twisted yarn, and the twisted yarn may be at least partially coated with the grip material.

In one instance, the coating of a core yarn can be a thermoplastic elastomer. In example aspects, the thermoplastic elastomer may comprise a thermoplastic polyurethane or a styrene ethylene/butylene styrene (SEBS). In addition, the core and the coating can be formed of different materials. For example, the core can be formed of a polymer and/or an elastomer that is different than a thermoplastic elastomer of the coating. The core and the coating can be formed to have different material properties, e.g., elasticity, melting temperature, and/or decomposition temperature, and/or other different properties. For example, the coating may have a first material composition (which may include a thermoplastic elastomer) having a lower melting temperature than the melting temperature of a second material composition forming the core. The second material forming the core may exclude the thermoplastic elastomer that is present in the coating.

In addition to a first yarn as described above, the knitted textile can include a second yarn or additional yarns that are different than the first yarn. In example aspects, the ratio of the first yarn to the second or additional yarns used to form the knitted textile be about 50:50 or about 60:40. For example, the first yarn and the second or additional yarns can differ through being formed from different materials, e.g., thermoforming materials or non-thermoforming materials, can differ through having different material properties, e.g., diameters, densities, deniers, tenacities, elasticities, tensile strengths, melting or decomposition temperatures, static/dynamic coefficients of friction, and/or other material properties, and/or can differ through having different constructions, e.g., a core/sheath construction or a singular or unified construction without a distinct core and sheath. The second yarn may have a material composition that excludes the thermoplastic elastomer in the coating and that has a greater melting temperature than the composition of the coating. Due at least in part to the material of the first yarn, the first yarn may have a higher coefficient of friction (COF) compared to textiles that do not include the first yarn. The higher COF enables the knit textile to "grip" a soccer ball leading to improved ball control.

In certain aspects herein, the knitted textile which forms the outer layer of the distal dorsal portion of the soccer goalie athletic glove may be thermoformed. When the knit textile is thermoformed, at least some of the first coating may flow and occupy at least a portion of spaces between courses of the first yarn, courses of the first core yarn, and/or courses of the second or additional yarns. This arrangement can advantageously integrate ball control directly into the knitted textile without the need for additional layers, streamlining the surface into a single functional layer. This single functional layer can help bring the wearer closer to the ball by removing a layer therefrom, which thereby increases proprioceptive feedback to the wearer and further improves ball control. Additionally, not including an extra layer improves manufacturing efficiency by reducing post-knitting processes, improves weatherization, and reduces weight.

Aspects of this disclosure may further include methods of manufacturing the knitted textile which forms the outer layer of the distal dorsal portion of the soccer goalie athletic glove. In a first example manufacturing method or process, a dorsal side of the glove is formed. A distal dorsal portion of the glove is formed having a lower edge and a three layer construction. The first layer is an interior textile layer. The next layer is a medial layer. The medial layer may be formed of, for example, polyurethane foam. The medial layer comprises an exterior foam surface. The exterior surface may include ridges, such as ribs, tunnels, peaks and troughs, corrugations, steps, or other uneven features forming ridges on the exterior formed surface. The ridges may be formed by thermally forming or pressing the exterior surface. The ridges, combined with the grip of the exterior knit surface of the distal dorsal portion of the glove, further provide control and stability when punching the ball. Such features where they occur, may extend across the exterior surface of the medial layer of the distal dorsal portion of the glove in any direction. The final layer is an exterior knit textile layer. The exterior knit textile layer forms the outermost layer of the glove and has a COF that may be greater than other areas of the glove. The exterior knit textile layer may comprise a first yarn, the first yarn comprising a first core yarn and a first coating The third knit textile layer may further comprise a second yarn, the second having a different material composition than a material composition of the first yarn. The exterior knit textile layer may further comprise a thermoformed network of interlooped yarns each having a core, such that a thermoplastic elastomer interconnects the interlooped yarns by surrounding at least a portion of each core and occupying at least a portion of spaces between yarns in the thermoformed network of interlooped yarns. The method further comprises forming a proximal dorsal portion of the glove having an upper edge. The proximal dorsal portion may comprise a textile. The lower edge of the distal dorsal portion of the glove is attached to the upper edge of the proximal dorsal portion of the glove at a dorsal seam, for example by stitching, adhesives, bonding, seam tape, and the like.

The method further comprises forming a palmar side of the glove. A distal palmar portion of the glove is formed having a lower edge. In some aspects the distal palmar portion may comprise at least an interior foam layer and an exterior later which may be made of, for example, leather, synthetic leather, polyurethane or latex. Various properties of the material used to form the exterior layer of the distal palmar portion may result in the distal palmar portion having a COF that is greater than other areas of the glove. The method further comprises forming a proximal palmar portion of the glove having an upper edge. The proximal palmar portion may comprise a textile. The lower edge of the distal palmar portion of the glove is attached to the upper edge of the proximal palmar portion of the glove at a palmar seam, for example by stitching, adhesives, bonding, seam tape, and the like.

A foamed latex or latex foam is created using a variety of polymers. Natural rubber latex may be leveraged to form a latex foam. Styrene-butadiene rubber, acrylonitrile butadiene rubber (e.g., nitrile rubber), ethylene vinyl acetate and/or polyurethane compositions may be formed as latex foam. These polymers can be used individually or blended to achieve properties for a palmar portion of an athletic glove.

The term "knitted textile" refers to a textile piece that is formed from at least one yarn that is manipulated (e.g., with a knitting machine) to form a plurality of intermeshed loops that define courses and wales. The term "course," as used herein, refers to a predominantly horizontal row of knit loops (in an upright textile as-knit) that are produced by adjacent needles during the same knitting cycle. The course may comprise one or more stitch types, such as a knit stitch, a held stitch, a float stitch, a tuck stitch, a transfer stitch, a rib stitch, and the like, as these terms are known in the art of knitting. The term "knit stitch," as used herein, refers to the basic stitch type where the yarn is cleared from the needle after pulling a loop of the yarn from the back to the front of the textile through a previous stitch. The term "wale," as used herein, is a predominantly vertical column of intermeshed or interlooped knit loops, generally produced by the same needle at successive (but not necessarily all) courses or knitting cycles. Knitted components described herein may include weft-knitted or warp-knitted components.

Additionally, there are various measurements provided herein. Unless indicated otherwise, all measurements provided herein are taken when the soccer goal keeper athletic glove is at standard ambient temperature and pressure (298.15 K and 100 kPa) and is in a resting (non-tensioned) state. Unless indicated otherwise, the term "about" or "substantially" with respect to a measurement means within ±10% of the indicated value.

FIG. 1 depicts an athletic glove 100 worn by a soccer goal keeper as it makes contact with a soccer ball. In accordance with aspects herein, the contact depicted is between the ball and the glove at a punch pad portion 102 of the glove on a dorsal surface of the glove. The contact depicted is herein referred to as punching the ball. Punching is used, for example, by goal keepers, to forcefully hit the ball away from the goal area.

Figure 2:
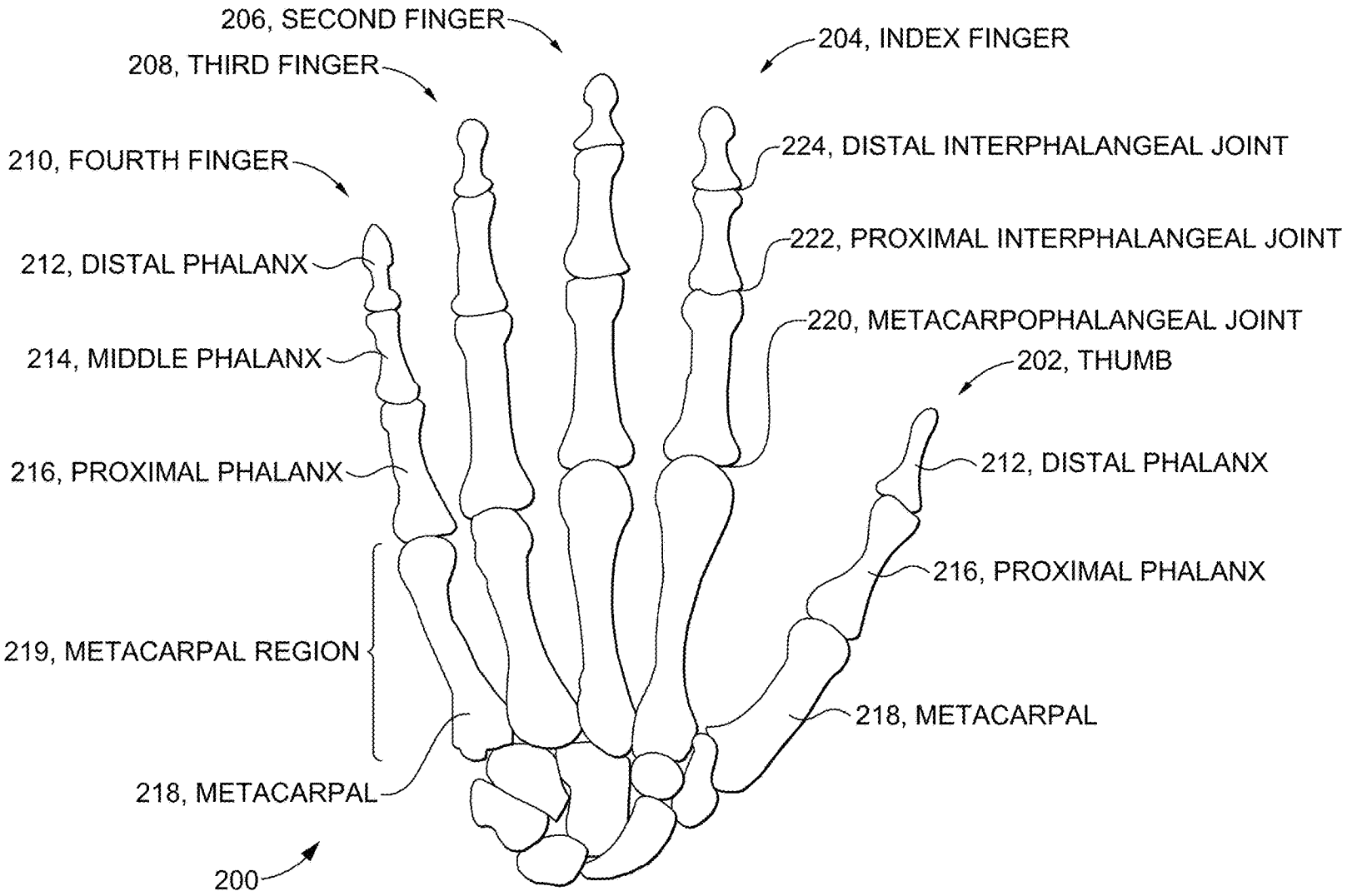
FIG. 2 depicts an anatomical structure of a hand for implementing embodiments in accordance with aspects herein.

FIG. 2 depicts an anatomical structure of a palmar side of a hand 200 that may be referenced in connection with embodiments herein. A wearer of a glove wears the glove over and around a hand having similar anatomical components as depicted as part of the hand 200. The hand 200 includes four fingers and a thumb 202. The four fingers, starting closest to the thumb 202 include an index finger 204, a second finger 206, a third finger 208, and a fourth finger 210. Each of the fingers 204-210 include a distal phalanx 212, a middle phalanx 214, a proximal phalanx 216, and a metacarpal bone 218. The middle phalanx 214 is also commonly referred to as an intermediate phalanx as a result of its location between the distal phalanx 212 and the proximal phalanx 216. The thumb 202 includes a similar set of bones as the fingers 204-210; however, the middle phalanx 214 is not included. Consequently, the thumb 202 includes the distal phalanx 212, the proximal phalanx 216, and the metacarpal bone 218.

At an intersection or joining of bones within the fingers 204-210 and the thumb 202, a joint is defined. For example, a distal interphalangeal joint 224 is defined as the intersection of the distal phalanx 212 and the middle phalanx 214. A proximal interphalangeal joint 222 is defined at the intersection of the middle phalanx 214 and the proximal phalanx 216. Additionally, a metacarpophalangeal joint 220 is defined at the intersection of the proximal phalanx 216 and the metacarpal bones 218. A metacarpal region 219 is proximal to the metacarpophalangeal joint 220 and is defined by the proximal end of the metacarpal bones 218 and the distal ends of the metacarpal bones 218.

A palmar side of the hand 200 is a side that includes the palm and is in a direction that the fingers 204-210 typically curl to create a fist or grasp an object. Therefore, when discussed herein, the palmar side of the hand 200 or of a glove that may be worn on the hand 200 is in the direction to which the fingers 204-210 are able to curl to create a fist of the hand 200.

Figure 3:
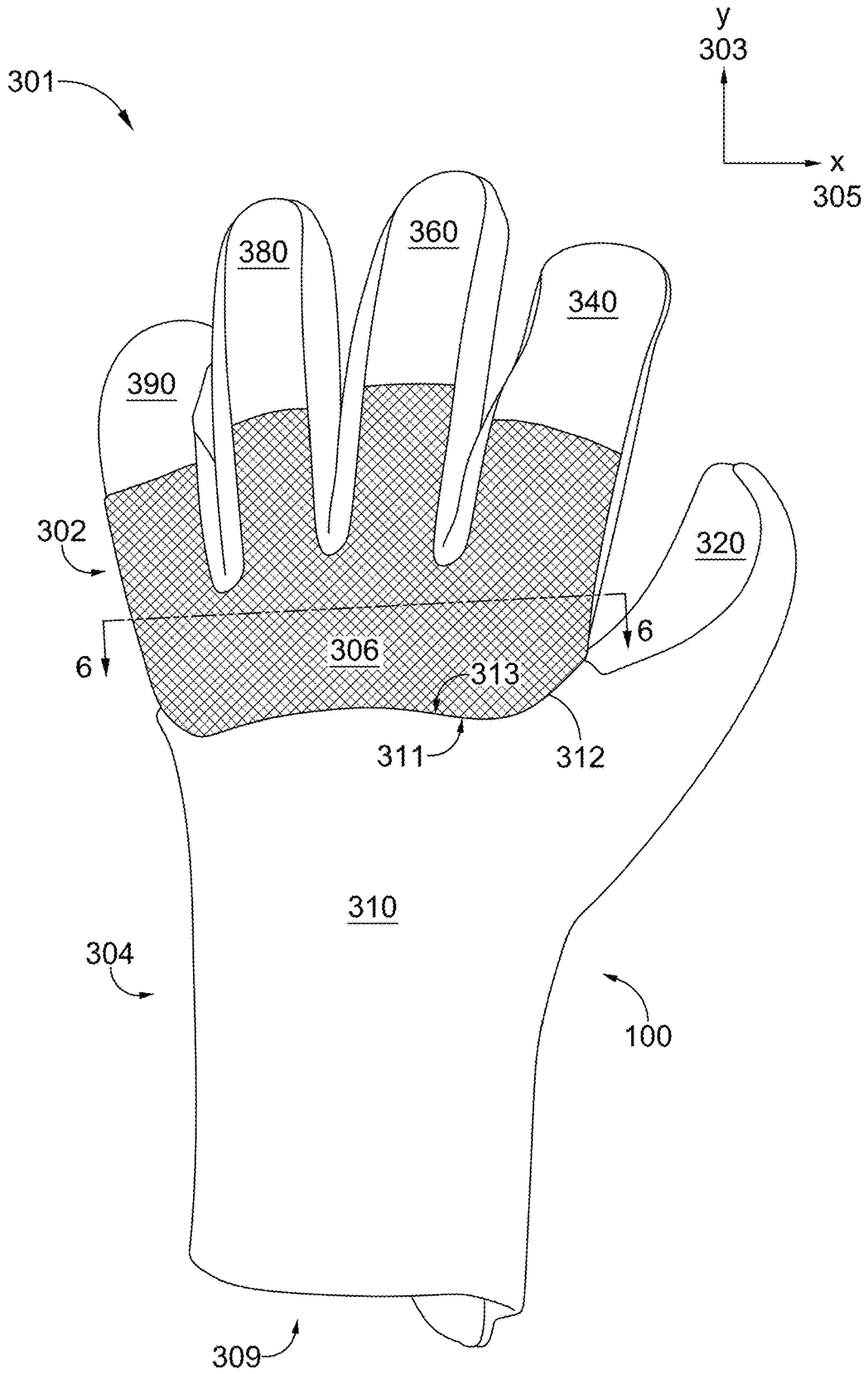
FIG. 3 depicts a dorsal view of an athletic glove in accordance with aspects herein.

FIG. 3 depicts a dorsal side 301 of the glove 100 in accordance with aspects herein. A distal dorsal portion 302 of the glove 100 comprises a dorsal index finger portion 340, a second dorsal finger portion 360, a third dorsal finger portion 380, a fourth dorsal finger portion 390, and a dorsal metacarpophalangeal joint portion 306, which commonly referred to as a punch pad. A proximal dorsal portion 304 comprises a dorsal thumb portion 320 and a center dorsal portion 310. The distal dorsal portion 302 and the proximal dorsal portion 304 are separated by a dorsal seam 312. The dorsal seam 312 comprises a lower edge 313 of the distal dorsal portion 302 and an upper edge 311 of the proximal dorsal portion 304. The distal dorsal portion 302 extends generally in the direction of a y-axis 303 from the lower edge 313 of the dorsal seam 312 to a distal end of each of the dorsal finger portions 340, 360, 380, and 390. The proximal dorsal portion 304 extends generally in the direction of the y-axis 303 from an opening 309 capable of receiving a hand, through the center dorsal portion 310, to the upper edge 311 at the dorsal seam 312. The proximal dorsal portion 304 further extends from a location overlaying the metacarpal bone 218 of the dorsal thumb portion 320 to a location overlaying the distal phalanx 212 of the dorsal thumb portion 320. The proximal dorsal portion 304 may comprise a material which may have a COF that is less than a COF of one or more other areas of the glove 100. As used herein, COF is relative to a common surface to be contacted, such as a ball. Therefore, in an example, when one portion of the glove has a greater COF than another portion of the glove, the COF is measured relative to a common surface of a ball.

In accordance with aspects herein, the dorsal seam 312 comprises the upper edge 311 and the lower edge 313. The dorsal seam 312 secures the distal dorsal portion 302 to the proximal dorsal portion 304. The distal dorsal portion 302 may be secured to the proximal dorsal portion 304 along the dorsal seam 312 by, for example, stitching, adhesives, bonding, seam tape, and the like. The dorsal seam 312 may be in the metacarpal region 219 of the dorsal side 301 of the glove 100. The dorsal seam 312 may be proximal to the metacarpophalangeal joint 220 when in an as-worn configuration on a goalie's hand. As shown in FIG. 3, the dorsal seam 312 may generally extend in the direction of an x-axis 305 across the metacarpal region 219 of the dorsal side 301 of the glove 100.

Figure 4:
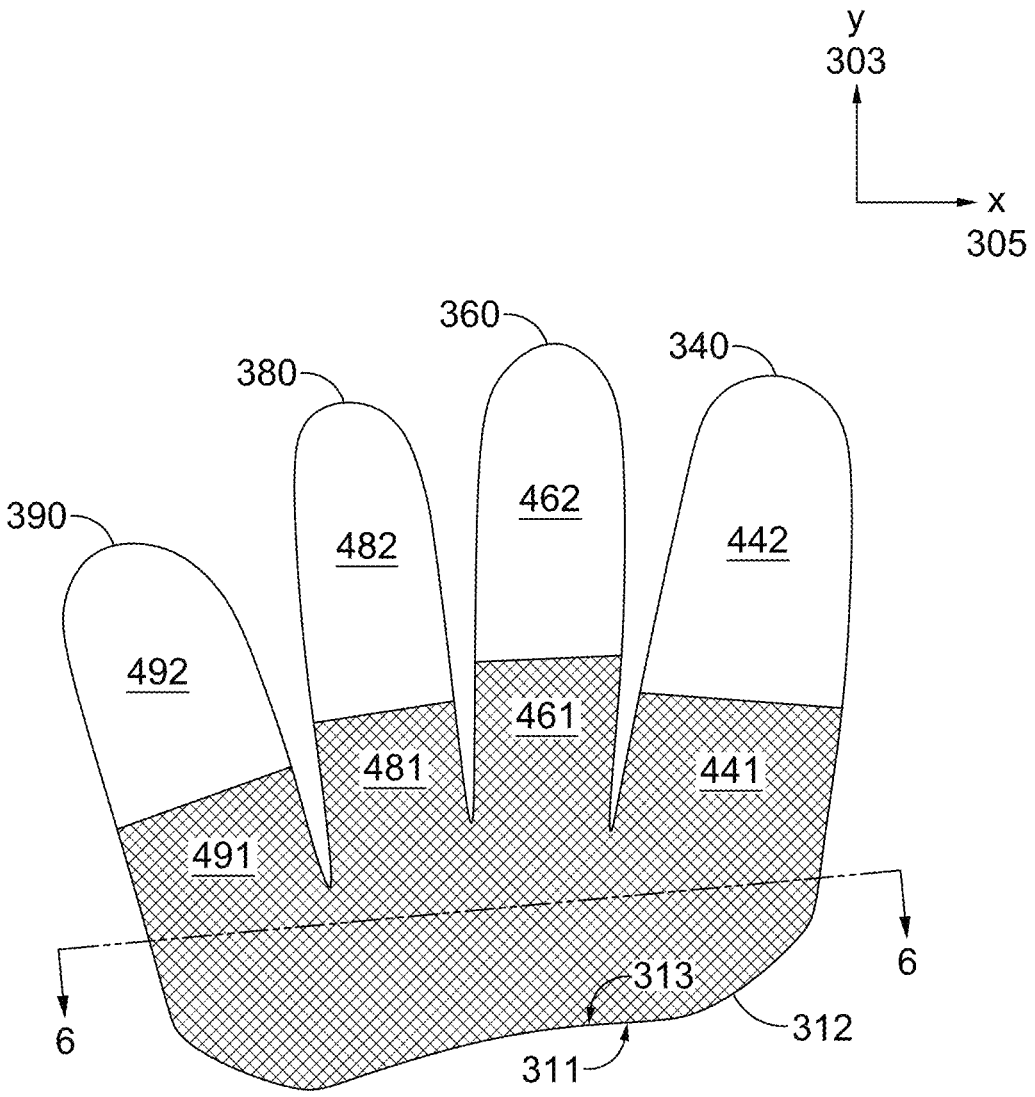
FIG. 4 depicts a distal dorsal portion of an athletic glove in accordance with aspects herein.

Turning now to FIG. 4, an isolated view of the distal dorsal portion 302 of the glove 100 from FIGS. 1 and 3 is depicted. As depicted in FIG. 3, the dorsal metacarpophalangeal joint portion 306 extends generally in the direction of the y-axis 303 from the upper edge 311 of the dorsal seam 312 to the distal-most edge of each of the dorsal finger portions 340, 360, 380, and 390. As is described herein with respect to the dorsal seam 312, the dorsal metacarpophalangeal joint portion 306 may include a portion of the metacarpal region 219.

The dorsal index finger portion 340 comprises an index proximal phalanx portion 441, which may cover at least a portion of the proximal phalanx 216 of the index finger 204. The dorsal index finger portion 340 further comprises and a distal phalanx portion 442, which may cover at least a portion of the middle phalanx 214 of the index finger 204 and a portion of the distal phalanx 212 of the index finger 204. The second dorsal finger portion 360 comprises a second proximal phalanx portion 461, which may cover at least a portion of the proximal phalanx 216 of the second finger 206. The second dorsal finger portion 360 further comprises a second distal phalanx portion 462, which may cover at least a portion of the middle phalanx 214 of the second finger 206 and a portion of the distal phalanx 212 of the second finger 206. The third dorsal finger portion 380 comprises a third proximal phalanx portion 481, which may cover at least a portion of the proximal phalanx 216 of the third finger 208. The third dorsal finger portion 380 further comprises a third distal phalanx portion 482, which may cover at least a portion of the middle phalanx 214 of the third finger 208 and a portion of the distal phalanx 212 of the third finger 208. The fourth dorsal finger portion 390 comprises a fourth proximal phalanx portion 491, which may cover at least a portion of the proximal phalanx 216 of the fourth finger 210. The fourth dorsal finger portion 390 further comprises a fourth distal phalanx portion 492, which may cover at least a portion of the middle phalanx 214 of the fourth finger 210 and a portion of the distal phalanx 212 of the fourth finger 210.

Returning to FIG. 3, the proximal dorsal portion 304 comprises the dorsal thumb portion 320 and the center dorsal portion 310. The dorsal thumb portion 320 may cover at least a portion of the metacarpal bone 218 of the thumb 202, the proximal phalanx 216 of the thumb 202, and the distal phalanx 212 of the thumb 202. The proximal dorsal portion 304 extends generally in the direction of the y-axis 303 from the opening 309 capable of receiving a hand to the lower edge 313 of the dorsal seam 312. Accordingly, the proximal dorsal portion 304 may cover at least a portion of the metacarpal bones 218 of the hand. The proximal dorsal portion 304 further extends from the metacarpal bone 218 of the dorsal thumb portion 320 to the distal phalanx 212 of the dorsal thumb portion 320. The proximal dorsal portion 304 may comprise a material which may have a COF that is less than a COF of one or more other areas of the glove 100.

Figure 5:
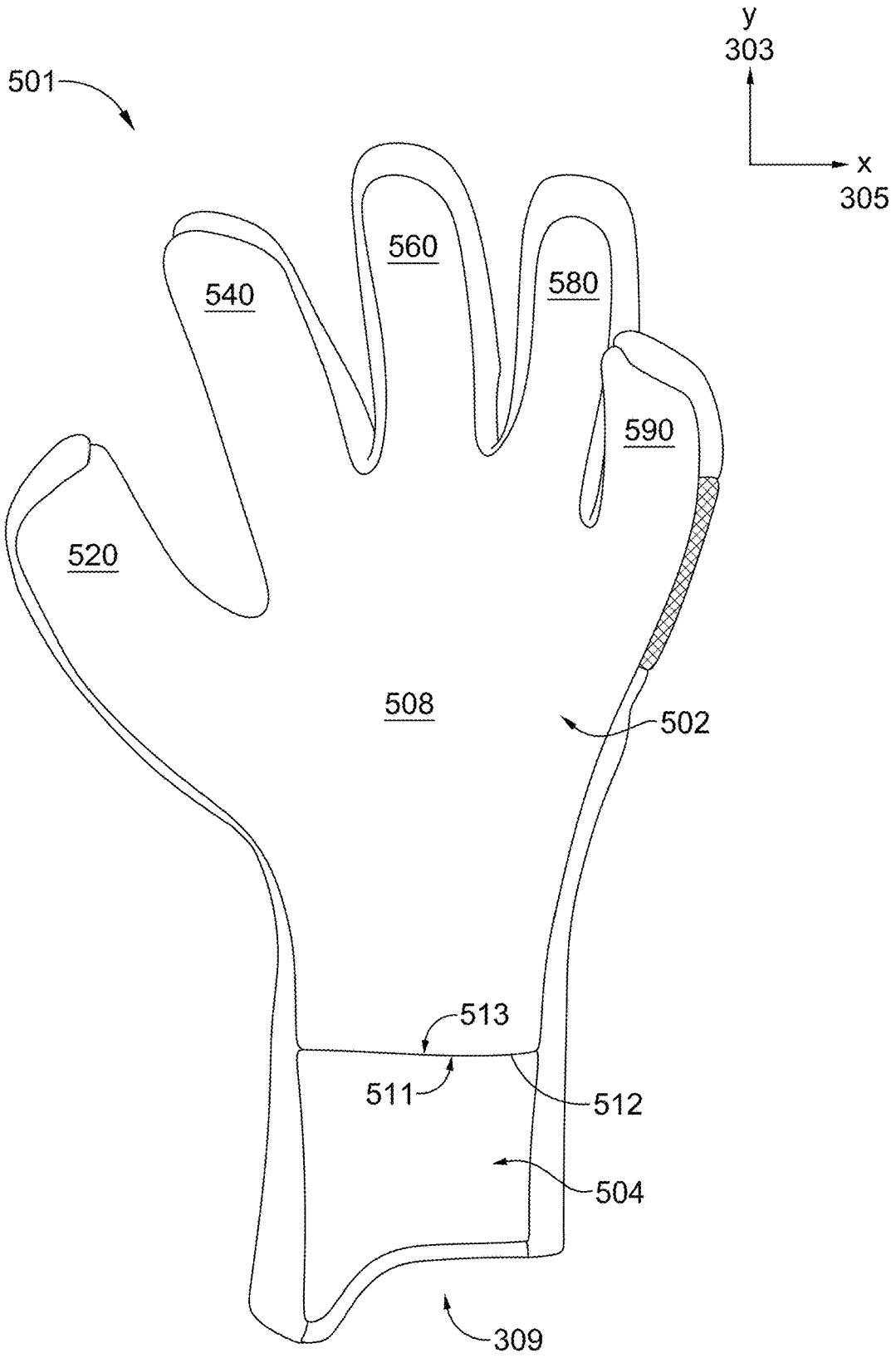
FIG. 5 depicts a palmar view of an athletic glove in accordance with aspects herein.

FIG. 5 depicts a palmar side 501 of the glove 100 of FIGS. 1 and 3 in accordance with aspects herein. A distal palmar portion 502 of the glove 100 comprises an palmar index finger portion 540, a second palmar finger portion 560, a third palmar finger portion 580, a fourth palmar finger portion 590, a palmar thumb portion 520, and a medial palmar portion 508. The distal palmar portion 502 further comprises a lower edge 513. The distal palmar portion 502 of the glove 100 extends generally in the direction of the y-axis 303 from the lower edge 513 to the distal most edge of each of the four palmar finger portions 540, 560, 580, 590. The distal palmar portion 502 further extends from a location overlaying the metacarpal bone 218 of the palmar thumb portion 520 to the distal most edge of the palmar thumb portion 520. A proximal palmar portion 504 of the glove 100 extends generally in the direction of the y-axis 303 from the opening 309 capable of receiving a hand to an upper edge 511. All or part of the distal palmar portion 502 may comprise a grip enhancing material which may have a COF that is greater than a COF of one or more other areas of the glove 100.

A palmar seam 512 comprises the lower edge 513 of the distal palmar portion 502 and the upper edge 511 of the proximal palmar portion 504. The palmar seam 512 secures the distal palmar portion 502 to the proximal palmar portion 504. The distal palmar portion 502 may be secured to the proximal palmar portion 504 along the palmar seam 512 by, for example, stitching, adhesives, bonding, seam tape, and the like.

Figure 6:
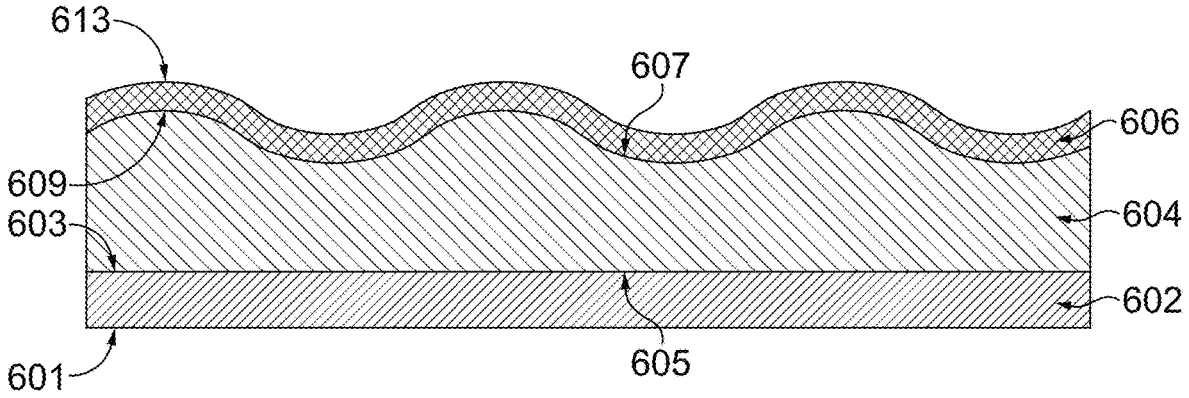
FIG. 6 depicts a cross-sectional view of the glove shown in FIG. 3 in accordance with aspects herein.

FIG. 6 illustrates a cross-section of the distal dorsal portion 302 taken at cut line 6-6 from FIG. 3, in accordance with aspects hereof. The layered structure of the distal dorsal portion 302 can be seen. The distal dorsal portion 302 comprises an interior textile layer 602, a medial layer 604, and an exterior knit textile layer, 606. The interior textile layer 602 comprises an interior textile surface 601 and an exterior textile surface 603. The medial layer 604 comprises an interior surface 605 and an exterior surface 607. The exterior knit textile layer 606 comprises an interior knit textile surface 609 and an exterior knit textile surface 613.

The interior textile layer 602 is included in the distal dorsal portion 302 of the glove 100 and provides the wearer with a comfortable fit. The interior textile surface 601 is capable of providing a skin-contacting surface with a hand when worn. The exterior textile surface 603 is in direct contact with the interior surface 605. In this way, the interior textile layer 602 protects the wearer's hand from the medial layer 604. In certain aspects, the interior textile layer 602 may be knit textile. The interior textile layer 602 may be a weft knit fabric or warp knit fabric. In some aspects, the interior textile layer 602 may include elastic fibers or synthetic fibers. The interior textile layer 602 may be a commercially available "rolled good" fabric. Such "rolled goods' are in a substantially planar (e.g., sheet-like) configuration in their raw state. These examples are not limiting, and it is contemplated herein that the interior textile layer 602 may be any fabric or textile suitable for providing a comfortable surface for the dorsal side 301 of the wearer's hand.

The medial layer 604 may be made of, for example, polyurethane foam. In some aspects, the exterior surface 607 of the medial layer 604 may include ridges. Examples of such ridges may include ribs, tunnels, peaks and troughs, corrugations, steps, or other uneven features forming the ridges on the exterior surface 607. In example aspects, the medial layer 604 may be thermally formed, shaped or molded, creating the ridges on the exterior surface 607. For example, the exterior surface 607 of the medial layer 604 may be may be thermally formed, shaped or molded to create the ridges on the exterior surface 607. These ridges create texture, which can be seen on the exterior knit textile surface 613. The ridges, combined with the grip of the exterior knit surface of the distal dorsal portion of the glove, may further provide control and stability when punching the ball. Such features where they occur, may extend across the exterior surface 607 in any direction. In other aspects, the medial layer 604 may comprise a relatively flat exterior surface 607. The medial layer 604 is included in the distal dorsal portion 302 of the glove 100 to absorb compressive energy when a goal keeper hits a soccer ball with the distal dorsal portion 302 of the glove 100, for example, when punching the ball. By absorbing compressive energy, the medial layer 604 protects the dorsal side 301 of the goal keeper's hand when making contact with the ball.

The exterior knit textile layer 606 may include one or more different types of yarns for imparting different functionality. Further, within the first yarn, the first core yarn and the first coating may have different material compositions to provide different properties. For example, as described herein, the first coating may comprise a low-processing temperature polymeric composition while the first core yarn may comprise a high-processing temperature polymeric composition such that the first coating may melt or deform at a temperature that leaves the core yarn intact. In one aspect, the deformation temperature of the polymeric composition of the first core yarn of the first yarn is at least 20 degrees Celsius higher than the melting temperature of the polymeric composition of the first coating, e.g., through use of a polymeric composition comprising a thermoplastic composition. This allows the core yarn to be coated by the coating when the coating is in a molten state.

The first core yarn of the first yarn may comprise a monofilament or multifilament yarn, such as a commercially available polyester or polyamide yarn having properties (such as denier and tenacity) sufficient for the yarn to be manipulated by industrial-scale knitting equipment. Further, the core yarn may be based on natural or man-made fibers including polyester, high-tenacity polyester, polyamide yarns, metal yarns, stretch yarns, carbon yarns, glass yarns, polyethylene or polyolefin yarns, bi-component yarns, Polytetrafluoroethylene ("PTFE") yarns, ultra-high-molecular-weight polyethylene ("UHMWPE") yarns, liquid crystal polymer yarns, specialty decorative yarns, reflective yarns, or a multi-component yarn comprising one or more of the yarns. In example aspects, the core yarn comprises a thermoplastic material comprising a polyester.

In various aspects, the first core yarn may be coated by any method known in the art. In one aspect, the polymeric compositions for the first coating disclosed herein are suitable for manufacturing by pultrusion and/or pulling the yarns through baths of liquid polymeric materials. In still another aspect, regardless of coating process, sufficient coating material is provided on the first yarn such that, when knit alone or with one or more other yarns in various configurations and subsequently thermoformed and allowed to reflow and resolidify, the coating material (e.g., polymeric composition comprising a thermoplastic elastomer) forms a structure with an adequate concentration of the coating material on one or more surfaces and/or within the first core yarn, depending upon the placement of the first yarn within the knit structure.

The first coating of the first yarn comprises a polymeric composition that comprises a thermoplastic composition that comprises a thermoplastic elastomer. Due at least in part to the material of the first yarn, the exterior knit textile layer 606 may have COF that is greater than a COF of one or more other areas of the glove 100. While it is possible to extrude a polymeric composition that is a thermoplastic elastomeric composition and form fibers, filaments, yarns, or films directly from the polymeric composition due to its elastomeric properties, these forms of the polymeric composition will have high levels of stretch and heat shrinkage. This means the fibers, filaments, yarns, or films may tend to stretch around machine guides rather than slide past them, and may tend to shrink at the temperatures commonly encountered in industrial-scale knitting and weaving equipment. However, by applying the polymeric composition as a coating onto a core yarn that is suitable to be mechanically manipulated, the resulting coated first yarn retains the tenacity and stretch resistance of the core yarn, while also providing an external-facing surface having superior traction and abrasion resistance provided by the polymeric composition of the coating due to its elastomeric properties. For example, it has been found that a 150-denier core yarn having a tensile strength of at least 1 kilogram-force at break, less than 20 percent strain to break, and a heat shrink of less than 20 percent may be coated with the polymeric composition to a nominal average outer diameter of up to about 1.0 millimeter and still retain its ability to be knit or inlaid using commercial flat-knitting equipment. Due to the ability to use this yarn on industrial-scale equipment, this first yarn may also allow for new methods of manufacturing that will allow for different placements of the polymeric composition within textiles and articles comprising the textiles at greater levels of specificity in terms of both location and amount as compared to conventional manufacturing processes.

Additionally, the thermoplastic nature of the polymeric composition makes it possible to melt the composition and use it to coat the first core yarn when the melting temperature of the polymeric composition is sufficiently lower than the deformation temperature of the first core yarn, as well as to subsequently thermoform the exterior knit textile layer 606 to create a thermoformed network comprising both the first core yarn and the reflowed and resolidified polymeric composition, thereby consolidating, bridging, and/or interconnecting the first core yarn. In one aspect, the thermoplastic elastomer(s) of the polymeric composition of the coating has a glass transition temperature(s) below minus 20 degrees Celsius, which allows the thermoplastic elastomer(s) present in the polymeric composition to be in their "rubbery" state, even when the exterior knit textile layer 606 is used in cold environments. In another aspect, the melting temperature of the polymeric composition of the coating is at least 100 degrees Celsius, which may help ensure that the polymeric composition will not melt when the exterior knit textile layer 606 is shipped or stored under hot conditions. In another aspect, the melting temperature of the polymeric composition of the coating is at least 130 degrees Celsius, which helps ensure that the polymeric composition will not melt when the exterior knit textile layer 606 is subjected to conditions often encountered by textiles during the manufacturing processes for articles of footwear, apparel, or sporting equipment, such as steaming processes. In another aspect, the melting temperature of the polymeric composition of the coating is at less than 170 degrees Celsius, which helps ensure that the exterior knit textile layer 606 may be thermoformed at temperatures that do not negatively impact other textiles or components that may form part of the glove 100. In another aspect, the enthalpy of the melting of the thermoplastic elastomer(s) of the polymeric composition of the coating may be less than about 30 Joules per gram or 25 Joules per gram, which means that, during the thermoforming process, less heat and a shorter heating time is required to fully melt the polymeric composition and achieve good flow of the molten polymeric composition to better consolidate, bridge, and/or interconnect the network of yarns in the exterior knit textile layer 606 In another aspect, the recrystallization temperature of the thermoplastic elastomer(s) of the polymeric composition of the coating may be above 60 degrees Celsius or above 95 degrees Celsius, which may promote rapid resolidification of the polymeric composition after thermoforming, which may reduce the amount of time required to cool the textile after thermoforming and may avoid the need to provide active cooling of the textile, thereby reducing cycle time and reducing energy consumption. Because the exterior knit textile layer 606 also includes the second or additional yarns in addition to the first yarn (i.e., the coated yarn), the thermoformed network of yarns (i.e., the core yarn from the first yarn and the second or additional yarns) is consolidated, bridged, and/or interconnected by the reflowed and resolidified polymeric composition. The presence of the reflowed and resolidified polymeric composition may serve one or more functions within the thermoformed textile, such as controlling the level of stretch within the entire exterior knit textile layer 606 or just within a region thereof, forming a skin having high abrasion resistance and/or traction across the surface of the exterior knit textile layer 606.

Use of the first yarn in the exterior knit textile layer 606 may also reduce the number of different materials required to form the glove 100. The coating of the first yarn, when thermoformed, may form a skin on a surface of the exterior knit textile layer 606. Alternatively or additionally, the coating of the first yarn, when thermoformed, may act as a bonding agent, either to bond yarns together within the exterior knit textile layer 606 or to bond other elements to a surface of the exterior knit textile layer 606 The use of the thermoformed exterior knit textile layer 606 described herein may replace one or more of the separate elements conventionally added to increase abrasion resistance or create traction, reducing waste and simplifying manufacturing processes while improving recyclability of the articles. Additionally, creating these properties within the knit structure of the exterior knit textile layer 606 rather than as an additional layer, helps the exterior knit textile layer 606 conform to the shape of the wearer's hand and enables more proprioceptive feedback, such as when punching a soccer ball.

This thermoformed network of the thermoformed textile may form an outer surface of the glove 100, such as the exterior knit textile layer 606 in FIG. 6. Unexpectedly, the thermoformed network created by thermoforming the textiles has superior properties for ball contact. For example, it has been found that using polymeric compositions having a Durometer Hardness (Shore A) of about 65 to about 85 results in athletic equipment, such as footwear uppers and gloves with improved ball spin rates. Further, due at least in part to the material of the first yarn and the thermoforming process, the exterior knit textile layer 606 may have a COF that is greater than a COF of one or more other areas of the glove 100.

Figure 7A:
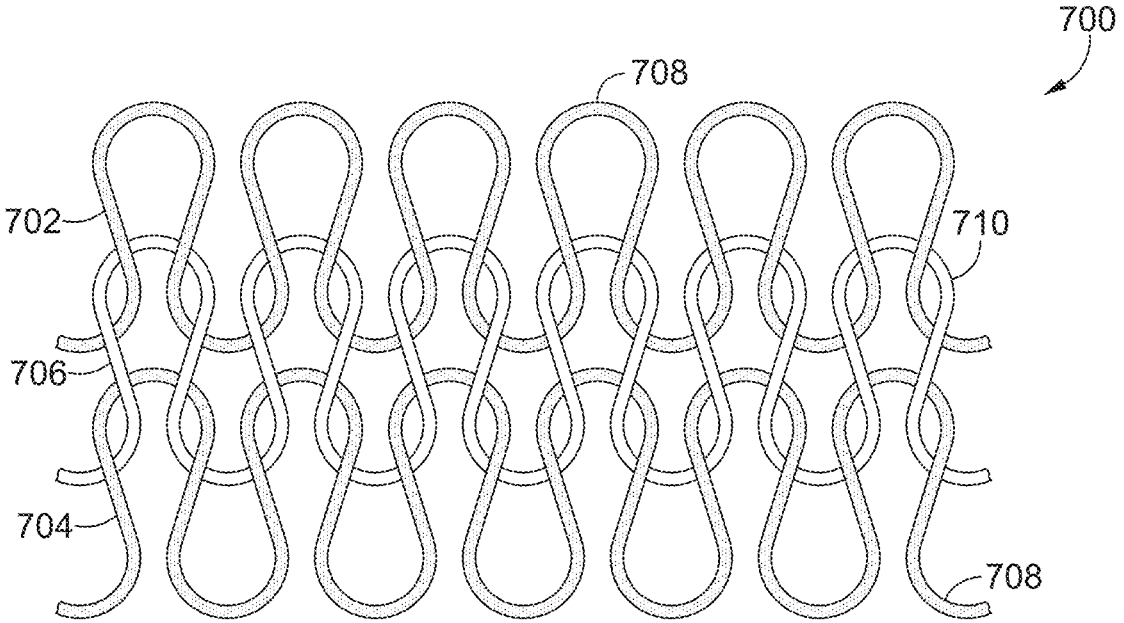
FIG. 7A illustrates a schematic representation of three interconnected courses of loops with the middle course being formed of a first yarn and the outer courses of loops being formed of a second yarn in accordance with aspects herein.

FIG. 7A schematically depicts a portion 700 of an example knitted component, which may be the exterior knit textile layer 606 of FIG. 6, prior to a thermoforming process. The portion 700 includes interconnected courses of a first yarn 710, which may be the first coated yarn described herein, and a second yarn 708, which may be the second yarn described with respect to FIG. 6 (i.e., a high-tenacity yarn). The portion 700 includes a first course 702 and a second course 704 having the second yarn 708, and a third course 706 of the first yarn 710. In such an aspect, the third course 706 of loops of the first yarn 710 may be interconnected (e.g., interlooped) to the first course 702 and the second course 704 having the second yarn 708.

Figure 7B:
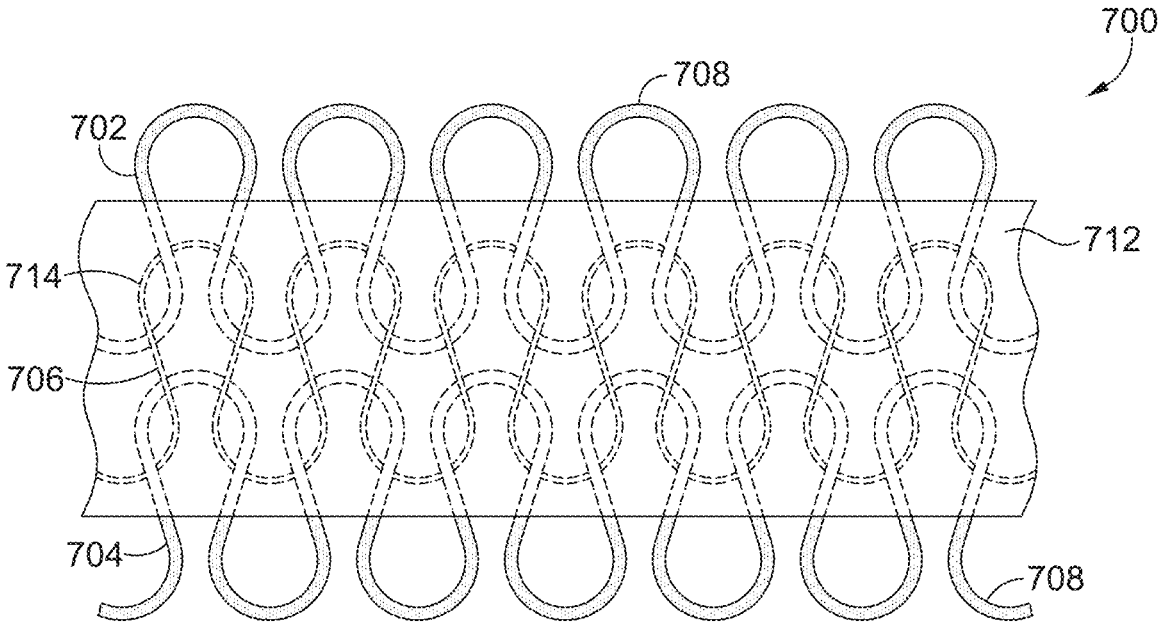
FIG. 7B illustrates a schematic representation of the interconnected courses of loops of FIG. 7A after being exposed to a thermoforming process in accordance with aspects herein.

FIG. 7B depicts the portion 700 after being exposed to a thermoforming process. As can be seen by comparing FIGS. 7A and 7B, the first yarn 710 that comprises a thermoplastic polymeric composition as described herein was thermoformed from a solid yarn structure into a melted yarn component 712, with a core yarn 714 of the first yarn 710 still remaining in its interlooped configuration. In certain aspects, the heating step of the thermoforming process at least partly causes the coating in the first yarn 710 to melt and flow and then subsequently solidify by the completion of the thermoforming process into the melted yarn component 712. This melted yarn component 712 is the coating surrounding the core yarn 714 of the first yarn 710 after that coating is melted, flowed, and resolidified.

The melted yarn component 712 in FIG. 7B is depicted as contacting and at least partially surrounding the core yarn 714 of the first yarn 710 and contacting and at least partially surrounding a portion of the second yarn 708 at least on the portions of the first course 702 and the second course 704 that interloop with or are proximate to the third course 706 forming a thermoformed network of interlooped yarns. However, the melted yarn component 712 may be thermoformed to spread to a greater extent or a lesser extent on the exterior knit textile surface 613 of the exterior knit textile layer 606 than is depicted in FIG. 7B. For example, if the exterior surface 607 of the medial layer 604 is thermally heated, as it may be in the process thermally forming, shaping or molding the exterior surface 607 to creating ridges, as described above, on the exterior knit textile layer 606, which may be adjacent to the medial layer 604 during the heating process, may be secondarily heated. The coating surrounding the core yarn 714 of the first yarn 710 may melt and flow or spread to a lesser extent on the exterior knit textile surface 613 of the exterior knit textile layer 606 than if the exterior knit textile layer 606 had been directly thermoformed. For example, the melted yarn component 712 in FIG. 7B may be formed by softening, partially melting, or fully melting the coating of the first yarn 710 while at least the core yarn 714 retains its solid structure. In one example, the coating of the first yarn 710 may be softened so that portions of the coating may be fused with adjacent other portions of the first yarn 710 as well as portions of the second yarn 708 within interlooped courses. In another, the coating may be partially melted so that the melted material of the coating may be reflowed and resolidified between adjacent structures within the knitted component to form the melted yarn component 712. In this way, the partially melted coating may fuse together adjacent portions of the first yarn 710, which comprises the core yarn 714 and remaining (non-melted) portions of the coating, as well as fusing to portions of the second yarn 708. In another example, the coating may be fully melted, reflowed and solidified so that the re-solidified coating fuses together portions of the remaining core yarn 714 and the second yarn 708.

In another example, the thermoformed network of interlooped yarns may be formed by applying a film of thermoplastic polymeric composition, such as that described herein, onto the exterior surface of an interlooped knit textile, such as the exterior knit textile surface 613, and subsequently heating the knit textile having the film thereon. During the heating step of the thermoforming process, the film of thermoplastic polymeric composition applied to the exterior surface of the interlooped knit textile may melt and flow into and around the yarns forming the knit textile. The thermoplastic polymeric composition may subsequently solidify by the completion of the thermoforming process resulting in the melted yarn component 712 as described herein. The resulting melted yarn component 712 created by thermoforming a film of thermoplastic polymeric composition applied to an exterior surface of an interlooped knit textile is contemplated as an alternative example of the melted yarn component 712 described herein being formed from thermoforming a thermoplastic polymeric composition coating surrounding a core yarn 714 as described above.

The areas with the melted yarn component 712 created from thermoforming may have increased abrasion resistance, traction and/or grip, and increased water resistance properties compared to areas without a thermoformed melted yarn component 712. Further, because these properties are provided through the knit structure instead of being applied as an additional layer or film, the portion 700 of the knitted component may remain relatively thin and flexible. As such, the melted yarn component 712 may be utilized in high-flex areas of athletic equipment, such as footwear uppers and gloves.

Note that FIGS. 7A and 7B are merely examples of knitting and thermoforming, as described herein. Other knit patterns with any plurality of adjacent rows, and/or any plurality of adjacent loops, of predominately the first yarn 710 or of predominately the second yarn 708 may be used for forming the exterior knit textile layer 606 of FIG. 6 as described herein without departing from the scope of the technology herein. For example, for simplicity of the illustration, the portion 700 is shown with only a single knit layer. However, it is contemplated that aspects of the disclosure may include a knitted component with a double-knit structure formed using needles on two needle beds. For example, the first yarn 710 may be knit on a front needle bed to form the loops in the third course 706 in FIG. 7A, which may form the exterior knit textile surface 613 of the knitted component, and in another course, such as a course knit simultaneously with the first course 702, the first yarn 710 may be knit on the back needle bed to form at least part of the second surface of the knitted component. Similarly, the second yarn 708 may be knit on a front needle bed to form the loops in the first course 702 and the second course 704 in FIG. 7A, which may form the first surface of the knitted component, and in another course, such as a course knit simultaneously with the third course 706, the second yarn 708 may be knit on the back needle bed to form at least part of the second surface of the knitted component. In some aspects, the first yarn 710 and/or the second yarn 708 may be moved back and forth between front and back needle beds within a single course. Additionally, in some aspects in which the portion 700 is part of a double-knit structure, loops forming courses for the first surface and/or second surface may be formed from a third or additional yarn. Further, in some aspects having a double-knit structure, the melted yarn component 712 may extend between the knit layers but not fully extend through the back layer to form the second surface. In alternative configurations, the melted yarn component 712 may still extend completely through both knit layers of a double-knit structure.

Example Properties of the First Yarn

As discussed above, textiles and shaped components may include the selective incorporation of yarns (referred to above as a first yarn) as described alone or in combination with other materials (e.g., second yarns that do not fall under the fibers, filaments, and yarns described herein). In certain aspects, the yarns and/or fibers described herein may be used to provide a specific functionality. For example, in certain aspects, yarn as described herein may be thermoformed to form a film having waterproof or water-resistant properties.

In one aspect, coated yarns, such as the first yarn, described herein have a break strength of about 0.6 to about 0.9 kilograms of applied force, or of about 0.7 to about 0.9 kilograms of applied force, or of about 0.8 to about 0.9 kilograms of applied force, or greater than 0.9 kilograms of applied force.

In an aspect, the yarns described herein are produced from fibers or filaments composed of only a single thermoplastic elastomer. In other aspects, the fibers are composed of a blend of two or more different thermoplastic elastomers.

In one aspect, the yarn is a coated yarn, wherein a core yarn comprises a second polymeric composition and a coating layer disposed on the core yarn, the coating layer comprising the first polymeric composition, wherein the first polymeric composition has a first melting temperature. In one aspect, the second polymeric composition is a second thermoplastic composition having a second deformation temperature, and the second deformation temperature is at least 20 degrees Celsius greater, at least 50 degrees Celsius greater, at least 75 degrees Celsius greater, or at least 100 degrees Celsius greater than the first melting temperature of the first polymeric composition. In another aspect, the second polymeric composition is a second thermoplastic composition having a second melting or deformation temperature, and the second deformation temperature is about 20 degrees Celsius greater, about 50 degrees Celsius greater, about 75 degrees Celsius greater, or about 100 degrees Celsius greater than the first melting temperature of the first polymeric composition.

In one aspect, the first polymeric composition includes a polymeric component. In one aspect, the first polymeric composition may include a single polymeric component (e.g., a single thermoplastic elastomer). In other aspects, the first polymeric composition may include two or more polymeric components (e.g., two or more different thermoplastic elastomers).

In one aspect, the second polymeric composition is a first thermoset composition. In one aspect, the second polymeric composition comprises a second thermoset composition. The core yarn may be any material that retains its strength at the temperature at which the first polymeric material is extruded during the coating process. The core yarn may be natural fibers, regenerated fibers or filaments, or synthetic fibers or filaments. In one aspect, the core yarn may be composed of cotton, silk, wool, rayon, nylon, elastane, polyester, polyamide, polyurethane, or polyolefin. In one aspect, the core yarn is composed of polyethylene terephthalate (PET). In one aspect, the second polymeric composition has a deformation temperature greater than 200 degrees Celsius, greater than 220 degrees Celsius, greater than 240 degrees Celsius, or between about 200 degrees Celsius to about 300 degrees Celsius.

In one aspect, the core yarn is a staple yarn, a multi-filament yarn, or a mono-filament yarn. In one aspect, the core yarn is polytwisted. In one aspect, the core yarn has a linear density of about 100 denier to about 300 denier, or of about 100 to about 250 denier, or about 100 to about 200 denier, or about 100 to 150 denier, or about 150 to 300 denier, or about 200 to 300 denier, or about 250 to 300 denier. In one aspect, the core yarn has a thickness of about 60 microns to 200 microns, about 60 to 160 microns, about 60 to 120 microns, about 60 to 100 microns, about 100 to 200 microns, or about 140 to 200 microns.

In one aspect, the core yarn is polyethylene terephthalate having a thickness of about 100 denier to about 200 denier, about 125 denier to about 175 denier, or about 150 denier to 160 denier. In one aspect, the core yarn is polyethylene terephthalate having a percent elongation of about 20 percent to about 30 percent, about 22 percent to about 30 percent, about 24 percent to about 30 percent, about 20 percent to about 28 percent, or about 20 percent to about 26 percent. In one aspect, the core yarn is polyethylene terephthalate having a tenacity of about one gram per denier to about ten grams per denier, about three grams per denier to about ten grams per denier, about five grams per denier to about ten grams per denier, about one gram per denier to about seven grams per denier, or about one gram per denier to about five grams per denier.

In one aspect, the coated yarn may be produced by extruding the coating (i.e., the first polymeric composition) onto the core yarn through an annular die or orifice such that the coating layer is axially centered surrounding the core yarn. The thickness of the coating applied to the core yarn may vary depending upon the application of the yarn. In one aspect, the coated yarn is used to produce a knitted textile. In one aspect, the coated yarn has a nominal average outer diameter of up to 1.00 millimeter, or of up to about 0.75 millimeters, or of up to about 0.5 millimeters, or of up to about 0.25 millimeters, or of up to about 0.2 millimeters, or of up to about 0.1 millimeters. In another aspect, the coating has a nominal average outer diameter of about 0.1 millimeters to about 1.00 millimeter, or about 0.1 millimeters to about 0.80 millimeters, or about 0.1 millimeters to about 0.60 millimeters. In another aspect, the coating on the yarn has an average radial coating thickness of about 50 micrometers to about 200 micrometers, or about 50 micrometers to about 150 micrometers, or about 50 micrometers to about 125 micrometers.

In one aspect, the core yarn has a thickness of about 100 denier to about 200 denier, about 125 denier to about 175 denier, or about 150 denier to 160 denier, and the coating has a nominal average outer diameter of about 0.10 millimeters to about 0.50 millimeters, or of about 0.10 millimeters to about 0.25 millimeters, or of about 0.10 millimeters to about 0.20 millimeters. In one aspect, the core yarn is polyethylene terephthalate having a thickness of about 100 denier to about 200 denier, about 125 denier to about 175 denier, or about 150 denier to about 160 denier, and the coating has a nominal average outer diameter of about 0.10 millimeters to about 0.50 millimeters, or of about 0.10 millimeters to about 0.25 millimeters, or of about 0.10 millimeters to about 0.20 millimeters.

In a further aspect, the coated yarn has a net total diameter from about 0.2 to about 0.6 millimeters, or about 0.3 to about 0.5 millimeters, or about 0.4 to about 0.6 millimeters. In some aspects, a lubricating oil including but not limited to, mineral oil or silicone oil, is present on the yarn at from about 0.5 percent to about two percent by weight, or from about 0.5 percent to about 1.5 percent by weight, or from about 0.5 percent to about one percent by weight. In some aspects, lubricating compositions are applied to the surface of the coated yarn before or during the process of forming the textile. In some aspects, the thermoplastic composition and the lubricating composition are miscible when the thermoplastic composition is reflowed and resolidified in the presence of the lubricating composition. Following reflowing and resolidification, the reflowed and solidified composition may comprise the lubricating composition.

In one aspect, the core yarn has a percent elongation of about eight percent to about 30 percent, about ten percent to about 30 percent, about 15 percent to about 30 percent, about 20 percent to about 30 percent, about ten percent to about 25 percent, or about ten percent to about 20 percent. In one aspect, the core yarn has a tenacity of about one gram per denier to about ten grams per denier, about two grams per denier to about eight grams per denier, about four grams per denier to about eight grams per denier, or about two grams per denier to about six grams per denier.

In one aspect, when thermoformed, the polymeric composition of the first coating has a melting temperature from about 100 degrees Celsius to about 210 degrees Celsius, optionally from about 110 degrees Celsius to about 195 degrees Celsius, from about 120 degrees Celsius to about 180 degrees Celsius, or from about 120 degrees Celsius to about 170 degrees Celsius. In another aspect, the first polymeric composition has a melting temperature greater than about 120 degrees Celsius and less than about 170 degrees Celsius, and optionally greater than about 130 degrees Celsius and less than about 160 degrees Celsius.

In a further aspect, when the melting temperature is greater than 100 degrees Celsius, the integrity of articles formed from or incorporating the first polymeric composition is preserved if the articles briefly encounter similar temperatures, for example, during shipping or storage. In another aspect, when the melting temperature is greater than 100 degrees Celsius, or greater than 120 degrees Celsius, articles formed from or incorporating the first polymeric composition may be steamed without melting or uncontrollably fusing any polyester components incorporated in the articles for purposes such as fill, zonal surface, or comfort features, as well as stretch yarn used for snugness and fit features.

In one aspect, when the melting temperature is greater than 120 degrees Celsius, materials incorporating the first or second polymeric composition disclosed herein are unlikely to soften and/or become tacky during use on a hot paved surface, a court surface, an artificial or natural football pitch, or a similar playing surface, track, or field. In one aspect, the higher the melting temperature of the first or second polymeric composition and the greater its enthalpy of melting, the greater the ability of an article of footwear or athletic equipment including gloves incorporating or constructed from the first or second polymeric composition to withstand contact heating excursions, frictional surface heating events, or environmental heating excursions. In one aspect, such heat excursions may arise when the articles contact hot ground, court, or turf surfaces, or heat excursions may arise from frictional heating that comes from rubbing or abrasion when the articles contact another surface such as the ground, another shoe, a ball, or the like.

In another aspect, when the melting temperature is less than about 210 degrees Celsius, or less than about 200 degrees Celsius, or less than about 190 degrees Celsius, or less than about 180 degrees Celsius, or less than about 175 degrees Celsius, but greater than about 120 degrees Celsius, or greater than about 110 degrees Celsius, or greater than about 103 degrees Celsius, polymer coated yarns may be melted for the purposes of molding and/or thermoforming a given region of textiles knitted therefrom in order to impart desirable design and aesthetic features in a short period of time.

In one aspect, a melting temperature lower than 140 degrees Celsius prevents or mitigates the risk of dye migration from polyester yarns incorporated in the footwear, gloves, or other articles. In a further aspect, dye migration from package-dyed polyester yarns or filaments is a diffusion-limited process, and short periods of exposure to temperatures greater than 140 degrees Celsius, such as during thermoforming, do not extensively damage, discolor, or otherwise render the appearance of the footwear, gloves, or other articles unacceptable. However, in another aspect, if the melting temperature of the polymer coating is greater than about 210 degrees Celsius, thermal damage and dye migration may occur.

In one aspect, a high melting enthalpy indicates that a longer heating time is required to ensure a polymer is fully melted and will flow well. In another aspect, a low melting enthalpy requires less heating time to ensure full melting and good flow.

In a further aspect, high cooling exotherms indicate rapid transitions from molten to solid. In another aspect, higher recrystallization temperatures indicate polymers are capable of solidifying at higher temperatures. In one aspect, high-temperature solidification is beneficial for thermoforming. In one aspect, recrystallization above 95 degrees Celsius promotes rapid setting after thermoforming, reduces cycle time, reduces cooling demands, and improves stability of shoe components during assembly and use.

In one aspect, viscosity of the coating compositions disclosed herein affects the properties and processing of the coating compositions. In a further aspect, high viscosities at low shear rates (e.g., less than one reciprocal second) indicate resistance to flow, displacement, and more solid-like behavior. In another aspect, low viscosities at higher shear rates (e.g., greater than ten reciprocal seconds) lend themselves to high-speed extrusion. In one aspect, as viscosity increases, the ability to adequately flow and deform to coat core yarn substrate becomes challenging. In another aspect, materials that exhibit high shear thinning indices (e.g., where viscosity at ten or 100 reciprocal seconds is lower than at one reciprocal second) may be challenging to extrude and may melt fracture if coated or extruded at a velocity that is too high.

In one aspect, the composition forming the first areas has a durometer Shore A hardness of about 50 to about 90 Shore A, optionally from about 55 to about 85 Shore A, from about 60 to about 80 Shore A, from about 60 to about 70 Shore A, or from about 67 to about 77 shore A.

In various aspects, the first polymeric composition for coating yarn has a cold Ross flex test result of about 120,000 to about 180,000 cycles, or of about 140,000 to about 160,000 cycles, or of about 130,000 to about 170,000 cycles when tested on a thermoformed plaque of the first polymeric composition for coating yarn in accordance with the cold Ross flex test as described herein below.

In one aspect, the polymeric composition or coating of the first yarn or the first areas has two or more of the first properties, or optionally three or more, four or more, five or more, six or more, seven or more, or all ten first properties provided above.

In addition to the first properties, when thermoformed, the first coating or polymeric composition of the first yarn or the first areas has one or more second properties. In one aspect, when thermoformed, the first coating or polymeric composition of the first yarn or the first areas has a glass transition temperature less than 50 degrees Celsius, optionally less than 30 degrees Celsius, less than zero degrees Celsius, less than −10 degrees Celsius, less than −20 degrees Celsius, or less than −30 degrees Celsius. In one aspect, when thermoformed, the first coating or polymeric composition of the first yarn or the first areas has a stress at break greater than seven megapascals, optionally greater than eight megapascals, as determined using the Modulus, Tenacity, and Elongation Test, at 25 degrees Celsius. In one aspect, when thermoformed, the first coating or polymeric composition of the first yarn or the first areas has a tensile stress at 300 percent modulus greater than two megapascals, optionally greater than 2.5 megapascals, or greater than three megapascals, as determined using the Modulus, Tenacity, and Elongation Test, at 25 degrees Celsius. In one aspect, when thermoformed, the first coating or polymeric composition of the first yarn or first areas has an elongation at break greater than 400 percent, optionally greater than 450 percent, optionally greater than 500 percent, or greater than 550 percent, as determined using the Modulus, Tenacity, and Elongation Test, at 25 degrees Celsius. In another aspect, when thermoformed, the first coating or polymeric composition of the first yarn or the first areas has two or more of the second properties, or optionally three or more, or all four second properties.

In certain aspects, the films, fibers, and yarns described herein can exhibit a tenacity greater than one gram/denier. In one aspect, the films, fibers, and yarns described herein can exhibit a tenacity of from about one gram/denier to about five grams/denier. In one or more aspects, the films, fibers, and yarns described herein can exhibit a tenacity of from about 1.5 grams/denier to about 4.5 grams/denier. In one aspect, the films, fibers, and yarns described herein can exhibit a tenacity of from about two grams/denier to about 4.5 grams/denier. "Tenacity" as used herein refers to a property of a fiber or yarn, and is determined using the respective testing method and sampling procedure described as follows. Specifically, tenacity and elongation of the yarn sample are determined according to the test method detailed in EN-ISO 2062 with the pre-load set to five grams. Elongation is recorded at the maximum tensile force value applied prior to breaking. Tenacity can be calculated as the ratio of load required to break the specimen to the linear density of the specimen.

In certain aspects, it may be desired to utilize a yarn that is suitable for use on commercial knitting equipment. A free-standing shrinkage of a yarn at 50 degrees Celsius is one property that can be predictive of a suitable yarn for use on a commercial knitting machine. In certain aspects, the films, fibers, filaments, and yarns described herein can exhibit a free-standing shrinkage when heated from 20 degrees Celsius to 70 degrees Celsius of less than 15 percent. In various aspects, the films, fibers, and yarns described herein can exhibit free-standing shrinkage when heated from 20 degrees Celsius to 70 degrees Celsius of about 0 percent to about 60 percent, about 0 percent to about 30 percent, or about 0 percent to about 15 percent. The term "free-standing shrinkage" as used herein refers to a property of a yarn and a respective testing method described as follows:

Yarn Shrinkage Test. The free-standing shrinkage of yarns can be determined by the following method. A yarn sample is prepared according to the Yarn Sampling Procedure described below, and is cut to a length of approximately 30 millimeters with minimal tension at approximately room temperature (e.g., 20 degrees Celsius). The cut sample is placed in a 50 degrees Celsius or 70 degrees Celsius oven for 90 seconds. The sample is removed from the oven and measured. The percentage of shrink is calculated using the pre-oven and post-oven measurements of the sample by dividing the post-oven measurement by the pre-oven measurement and multiplying by 100.

Yarn Sampling Procedure. Yarn to be tested is stored at room temperature (20 degrees Celsius to 24 degrees Celsius) for 24 hours prior to testing. The first three meters of material are discarded. A sample yarn is cut to a length of approximately 30 millimeters with minimal tension at approximately room temperature (e.g., 20 degrees Celsius).

In one or more aspects, the free-standing shrinkage of a yarn at 70 degrees Celsius can be a useful indicator of the ability of a yarn to be exposed to certain environmental conditions without any substantial changes to the physical structure of the yarn. In certain aspects, a yarn comprising the low-processing temperature polymeric composition can exhibit a free-standing shrinkage when heated from 20 degrees Celsius to 70 degrees Celsius of from about 0 percent to about 60 percent. In one or more aspects, a yarn comprising the low-processing temperature polymeric composition can exhibit a free-standing shrinkage when heated from 20 degrees Celsius to 70 degrees Celsius of from about 0 percent to about 30 percent. In one aspect, a yarn comprising the low-processing temperature polymeric composition can exhibit a free-standing shrinkage when heated from 20 degrees Celsius to 70 degrees Celsius of from about 0 percent to about 20 percent.

As discussed above, in certain aspects, the first polymeric composition as described herein and the second polymeric composition have differing properties. In various aspects, these differing properties allow for the coated fibers, as described herein, during a thermoforming process, to melt and flow, and subsequently cool and solidify into a different structure than of that prior to the thermoforming process (e.g., thermoform from a yarn to a melted yarn component), while an uncoated fiber cannot deform or melt during such a process and can maintain its structure (e.g., as a yarn) when the thermoforming process is conducted at a temperature below the melting temperature of the uncoated fibers. In such aspects, the melted yarn component formed from the coated fibers as described herein during the thermoforming process may be integrally connected to the non-altered structure (e.g., a yarn or fiber), which can provide three-dimensional structure and/or other properties targeted to specific spots on an article of wear.

Example Thermoplastic Elastomers

In various aspects, the polymeric compositions for the coating of the first yarn described herein comprise one or more thermoplastic elastomers. In an aspect, an "elastomer" is defined as a material having an elongation at break greater than 400 percent as determined using ASTM D-412-98 at 25 degrees Celsius. In another aspect, the elastomer is formed into a plaque, wherein the plaque has a break strength of from ten to 35 kilogram-force (kgf), or of from about ten to about 25 kilogram-force, or of from about ten to about 20 kilogram-force, or of from about 15 to about 35 kilogram-force, or of from about 20 to about 30 kilogram-force. In another aspect, tensile breaking strength or ultimate strength, if adjusted for cross-sectional area, is greater than 70 kilogram-force per square centimeter, or greater than 80 kilogram-force per square centimeter. In another aspect, the elastomer plaque has a strain to break of from 450 percent to 800 percent, or from 500 to 800 percent, or from 500 to 750 percent, or from 600 to 750 percent, or from 450 to 700 percent. In still another aspect, the elastomer plaque has a load at 100 percent strain of from about three to about eight kilogram-force per millimeter, or of from about three to about seven kilogram-force per millimeter, or of from about 3.5 to about 6.5 kilogram-force per millimeter, or of from about four to about five kilogram-force per millimeter. In one aspect, the elastomer plaque has a toughness of from 850 kilogram·millimeters to 2,200 kilogram·millimeters, or of from about 850 kilogram·millimeters to about 2,000 kilogram·millimeters, or of from about 900 kilogram·millimeters to about 1,750 kilogram·millimeters, or of from about 1,000 kilogram·millimeters to about 1,500 kilogram·millimeters, or of from about 1,500 kilogram·millimeters to about 2,000 kilogram·millimeters. In an aspect, the elastomer plaque has a stiffness of from about 35 to about 155, or of from about 50 to about 150, or of from about 50 to about 100, or of from about 50 to about 75, or of from about 60 to about 155, or of from about 80 to about 150. In still another aspect, the elastomer plaque has a tear strength of from about 35 to about 80, or of from about 35 to about 75, or of from about 40 to about 60, or of from about 45 to about 50.

In aspects, exemplary thermoplastic elastomers include homopolymers and copolymers. The term "polymer" refers to a polymerized molecule having one or more monomer species, and includes homopolymers and copolymers. The term "copolymer" refers to a polymer having two or more monomer species, and includes terpolymers (i.e., copolymers having three monomer species). In certain aspects, the thermoplastic elastomer is a random copolymer. In one aspect, the thermoplastic elastomer is a block copolymer. For example, the thermoplastic elastomer may be a block copolymer having repeating blocks of polymeric units of the same chemical structure (segments) that are relatively harder (hard segments), and repeating blocks of polymeric segments that are relatively softer (soft segments). In various aspects, in block copolymers, including block copolymers having repeating hard segments and soft segments, physical cross-links may be present within the blocks or between the blocks or both within and between the blocks. Particular examples of hard segments include isocyanate segments and polyamide segments. Particular examples of soft segments include polyether segments and polyester segments. As used herein, the polymeric segment may be a particular type of polymeric segment such as, for example, an isocyanate segment, a polyamide segment, a polyether segment, a polyester segment, and the like. It is understood that the chemical structure of the segment is derived from the described chemical structure. For example, an isocyanate segment is a polymerized unit including an isocyanate functional group. When referring to a block of polymeric segments of a particular chemical structure, the block may contain up to ten mol percent of segments of other chemical structures. For example, as used herein, a polyether segment is understood to include up to ten mol percent of non-polyether segments.

In one aspect, the first polymeric composition comprises a polymeric component consisting of all the polymers present in the polymeric composition; optionally, wherein the polymeric component comprises two or more polymers, wherein the two or more polymers differ from each other in chemical structure of individual segments of each of the two or more polymers, or in molecular weight of each of the two or more polymers, or in both.

In various aspects, the thermoplastic elastomer may include one or more of a thermoplastic copolyester elastomer, a thermoplastic polyether block amide elastomer, a thermoplastic polyurethane elastomer, a polyolefin-based copolymer elastomer, a thermoplastic styrenic copolymer elastomer, a thermoplastic ionomer elastomer, or any combination thereof. In one aspect, the first polymeric composition comprises a thermoplastic elastomeric styrenic copolymer. In a further aspect, the thermoplastic elastomeric styrenic copolymer may be a styrene butadiene styrene (SBS) block copolymer, a styrene ethylene/butylene styrene (SEBS) resin, a styrene acrylonitrile (SAN) resin, or any combination thereof. In one aspect, a polymeric composition comprises a thermoplastic elastomeric polyester polyurethane, a thermoplastic polyether polyurethane, or any combination thereof. In some aspects, the thermoplastic elastomeric polyester polyurethane may be an aromatic polyester, an aliphatic composition, or a combination thereof. It should be understood that other thermoplastic polymeric materials not specifically described below are also contemplated for use in the coated fiber, as described herein, and/or in an uncoated fiber. In one aspect, a polymeric composition comprising a thermoplastic elastomer has a melting temperature greater than about 110 degrees Celsius and less than about 170 degrees Celsius. In another aspect, a polymeric composition comprising a thermoplastic elastomer has a melting temperature of about 110 degrees Celsius to about 170 degrees Celsius, about 115 degrees Celsius to about 160 degrees Celsius, about 120 degrees Celsius to about 150 degrees Celsius, about 125 degrees Celsius to about 140 degrees Celsius, about 110 degrees Celsius to about 150 degrees Celsius, or about 110 degrees Celsius to about 125 degrees Celsius.

In various aspects, the thermoplastic elastomer has a glass transition temperature (Tg) less than 50 degrees Celsius when determined in accordance with ASTM D3418-97 as described herein below. In some aspects, the thermoplastic elastomer has a glass transition temperature (Tg) of about −60 degrees Celsius to about 50 degrees Celsius, about −25 degrees Celsius to about 40 degrees Celsius, about −20 degrees Celsius to about 30 degrees Celsius, about −20 degrees Celsius to about 20 degrees Celsius, or of about −10 degrees Celsius to about ten degrees Celsius when determined in accordance with ASTM D3418-97 as described herein below. In one aspect, the glass transition temperature of the thermoplastic elastomer is selected such that articles incorporating the coated yarns disclosed herein, wherein the coated yarns comprise a coating material comprising the thermoplastic elastomer, have a thermoplastic material above its glass transition temperature during normal wear when incorporated into an article of footwear, gloves, or other athletic equipment (i.e., is more rubbery and less brittle).

In one aspect, the thermoplastic elastomer comprises: (a) a plurality of first segments; (b) a plurality of second segments; and, optionally, (c) a plurality of third segments. In various aspects, the thermoplastic elastomer is a block copolymer. In some aspects, the thermoplastic elastomer is a segmented copolymer. In further aspects, the thermoplastic elastomer is a random copolymer. In still further aspects, the thermoplastic elastomer is a condensation copolymer.

In a further aspect, the thermoplastic elastomer has a weight average molecular weight of about 50,000 Daltons to about 1,000,000 Daltons, about 50,000 Daltons to about 500,000 Daltons, about 75,000 Daltons to about 300,000 Daltons, or about 100,000 Daltons to about 200,000 Daltons.

In a further aspect, the thermoplastic elastomer has a ratio of first segments to second segments from about 1:1 to about 1:2 based on the weight of each of the first segments and the second segments, or of about 1:1 to about 1:1.5 based on the weight of each of the first segments and the second segments.

In a further aspect, the thermoplastic elastomer has a ratio of first segments to third segments from about 1:1 to about 1:5 based on the weight of each of the first segments and the third segments, about 1:1 to about 1:3 based on the weight of each of the first segments and the third segments, about 1:1 to about 1:2 based on the weight of each of the first segments and the third segments, or about 1:1 to about 1:3 based on the weight of each of the first segments and the third segments.

In a further aspect, the thermoplastic elastomer has first segments derived from a first component having a number-average molecular weight of about 250 Daltons to about 6,000 Daltons, about 400 Daltons to about 6,000 Daltons, about 350 Daltons to about 5,000 Daltons, or about 500 Daltons to about 3,000 Daltons.

In some aspects, the thermoplastic elastomer comprises phase-separated domains. For example, a plurality of first segments can phase-separate into domains comprising primarily the first segments. Moreover, a plurality of second segments derived from segments having a different chemical structure can phase-separate into domains comprising primarily the second segments. In some aspects, the first segments can comprise hard segments, and the second segments can comprise soft segments. In other aspects, the thermoplastic elastomer can comprise phase-separated domains comprising a plurality of first copolyester units.

In one aspect, prior to thermoforming, a polymeric composition has a glass transition temperature of from about 20 degrees Celsius to about −60 degrees Celsius. In one aspect, prior to thermoforming, a polymeric composition has a Taber Abrasion Resistance of from about 10 milligrams to about 40 milligrams as determined by ASTM D3389. In one aspect, prior to thermoforming, a polymeric composition has a Durometer Hardness (Shore A) of from about 60 to about 90 as determined by ASTM D2240. In one aspect, prior to thermoforming, a polymeric composition has a specific gravity of from about 0.80 g/cm$^3$ to about 1.30 g/cm$^3$ as determined by ASTM D792. In one aspect, prior to thermoforming, a polymeric composition has a melt flow index of about two grams/ten minutes to about 50 grams/ten minutes at 160 degrees Celsius using a test weight of 2.16 kilograms. In one aspect, prior to thermoforming, a polymeric composition has a melt flow rate greater than about two grams/ten minutes at 190 degrees Celsius or 200 degrees Celsius when using a test weight of ten kilograms. In one aspect, prior to thermoforming, the polymeric composition has a modulus of about 1 megapascal to about 500 megapascals.

Example Thermoplastic Polyurethane Elastomers

In certain aspects, the thermoplastic elastomer, as used for the coating of the first yarn in some aspects herein, is a thermoplastic polyurethane (TPU) elastomer. The thermoplastic polyurethane elastomer may be a thermoplastic block polyurethane copolymer. The thermoplastic polyurethane copolymer may be a copolymer comprising hard segments and soft segments, including blocks of hard segments and blocks of soft segments. The hard segments may comprise or consist of isocyanate segments. In the same or alternative aspects, the soft segments may comprise or consist of polyether segments, or polyester segments, or a combination of polyether segments and polyester segments. In one aspect, the thermoplastic material, or the polymeric component of the thermoplastic material, may comprise or consist essentially of an elastomeric thermoplastic polyurethane hard segments and soft segments, such as an elastomeric thermoplastic polyurethane having repeating blocks of hard segments and repeating blocks of soft segments.

In aspects, one or more of the thermoplastic polyurethane elastomers can be produced by polymerizing one or more isocyanates with one or more polyols to produce copolymer chains having carbamate linkages, such as (—N(CO)O—), as illustrated below in Formula 1, where the isocyanate(s) each preferably include two or more isocyanate (—NCO) groups per molecule, such as two, three, or four isocyanate groups per molecule (although single-functional isocyanates can also be optionally included, e.g., as chain-terminating units).

(Formula 1)

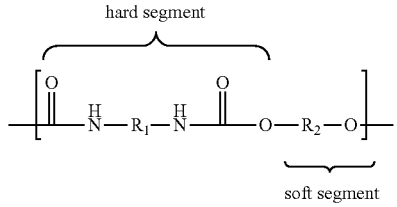

In these aspects, each $R_1$ and $R_2$ independently is an aliphatic or aromatic segment. Optionally, each R2 can be a hydrophilic segment. Unless otherwise indicated, any of the functional groups or chemical compounds described herein can be substituted or unsubstituted. A "substituted" group or chemical compound, such as an alkyl, alkenyl, alkynyl, cycloalkyl, cycloalkenyl, aryl, heteroaryl, alkoxyl, ester, ether, or carboxylic ester, referring to an alkyl, alkenyl, alkynyl, cycloalkyl, cycloalkenyl, aryl, heteroaryl, alkoxyl, ester, ether, or carboxylic ester group, has at least one hydrogen radical that is substituted with a non-hydrogen radical (i.e., a substituent). Examples of non-hydrogen radicals (or substituents) include, but are not limited to, alkyl, cycloalkyl, alkenyl, cycloalkenyl, alkynyl, ether, aryl, heteroaryl, heterocycloalkyl, hydroxyl, oxy (or oxo), alkoxyl, ester, thioester, acyl, carboxyl, cyano, nitro, amino, amido, sulfur, and halo. When a substituted alkyl group includes more than one non-hydrogen radical, the substituents can be bound to the same carbon or two or more different carbon atoms.

Additionally, the isocyanates can also be chain-extended with one or more chain extenders to bridge two or more isocyanates. This can produce polyurethane copolymer chains, as illustrated below in Formula 2, wherein $R_3$ includes the chain extender. As with each $R_1$ and $R_3$, each $R_3$ independently is an aliphatic or aromatic segment.

(Formula 2)

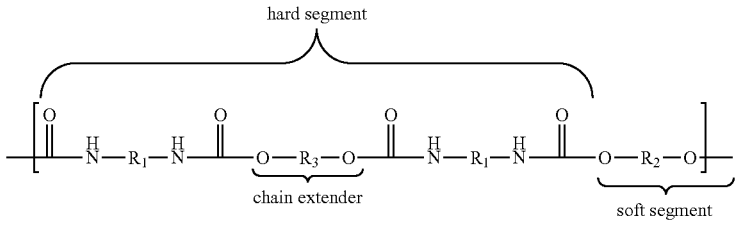

Each segment $R_1$, or the first segment, in Formulas 1 and 2 can independently include a linear or branched $C_{3-30}$ segment, based on the particular isocyanate(s) used, and can be aliphatic, aromatic, or include a combination of aliphatic portions(s) and aromatic portion(s). The term "aliphatic" refers to a saturated or unsaturated organic molecule that does not include a cyclically conjugated ring system having delocalized pi electrons. In comparison, the term "aromatic" refers to a cyclically conjugated ring system having delocalized pi electrons, which exhibits greater stability than a hypothetical ring system having localized pi electrons.

Each segment $R_1$ can be present in an amount of five percent to 85 percent by weight, from five percent to 70 percent by weight, or from ten percent to 50 percent by weight, based on the total weight of the reactant monomers.

In aliphatic aspects (from aliphatic isocyanate[s]), each segment $R_1$ can include a linear aliphatic group, a branched aliphatic group, a cycloaliphatic group, or combinations thereof. For instance, each segment R1 can include a linear or branched $C_{3-20}$ alkylene segment (e.g., $C_{4-15}$ alkylene or $C_{6-10}$ alkylene), one or more $C_{3-8}$ cycloalkylene segments (e.g., cyclopropyl, cyclobutyl, cyclopentyl, cyclohexyl, cycloheptyl, or cyclooctyl), and combinations thereof.

Examples of suitable aliphatic diisocyanates for producing the polyurethane copolymer chains include hexamethylene diisocyanate (HDI), isophorone diisocyanate (IPDI), butylenediisocyanate (BDI), bisisocyanatocyclohexylmethane (HMDI), 2,2,4-tri methylhexamethylene diisocyanate (TMDI), bisisocyanatomethylcyclohexane, bisisocyanatomethyltricyclodecane, norbornane diisocyanate (N DI), cyclohexane diisocyanate (CHDI), 4,4'-dicyclohexylmethane diisocyanate (H12MDI), diisocyanatododecane, lysine diisocyanate, and combinations thereof.

In aromatic aspects (from aromatic isocyanate[s]), each segment $R_1$ can include one or more aromatic groups, such as phenyl, naphthyl, tetrahydronaphthyl, phenanthrenyl, biphenylenyl, indanyl, indenyl, anthracenyl, and fluorenyl. Unless otherwise indicated, an aromatic group can be an unsubstituted aromatic group or a substituted aromatic group, and can also include heteroaromatic groups. "Heteroaromatic" refers to monocyclic or polycyclic (e.g., fused bicyclic and fused tricyclic) aromatic ring systems, where one to four ring atoms are selected from oxygen, nitrogen, or sulfur, and the remaining ring atoms are carbon, and where the ring system is joined to the remainder of the molecule by any of the ring atoms. Examples of suitable heteroaryl groups include pyridyl, pyrazinyl, pyrimidinyl, pyrrolyl, pyrazolyl, imidazolyl, thiazolyl, tetrazolyl, oxazolyl, isooxazolyl, thiadiazolyl, oxadiazolyl, furanyl, quinolinyl, isoquinolinyl, benzoxazolyl, benzimidazolyl, and benzothiazolyl.

Examples of suitable aromatic diisocyanates for producing the polyurethane copolymer chains include toluene diisocyanate (TDI), TDI adducts with trimethyloylpropane TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (N DI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some aspects, the copolymer chains are substantially free of aromatic groups.

In particular aspects, the polyurethane copolymer chains are produced from diisocyanates including HMDI, TDI, MDI, H12 aliphatics, and combinations thereof. For example, the coated fiber as described herein of the present disclosure can comprise one or more polyurethane copolymer chains that are produced from diisocynates including HMDI, TDI, MDI, $H_{12}$ aliphatics, and combinations thereof.

In certain aspects, polyurethane chains that are cross-linked (e.g., partially cross-linked polyurethane copolymers that retain thermoplastic properties) or which can be cross-linked can be used in accordance with the present disclosure. It is possible to produce cross-linked or cross-linkable polyurethane copolymer chains using multi-functional isocyanates. Examples of suitable triisocyanates for producing the polyurethane copolymer chains include TDI, HDI, and IPDI adducts with trimethyloylpropane (TMP), uretdiones (i.e., dimerized isocyanates), polymeric MDI, and combinations thereof.

Segment $R_3$ in Formula 2 can include a linear or branched $C_2$-$C_{10}$ segment, based on the particular chain extender polyol used, and can be, for example, aliphatic, aromatic, or polyether. Examples of suitable chain extender polyols for producing the polyurethane copolymer chains include ethylene glycol, lower oligomers of ethylene glycol (e.g., diethylene glycol, triethylene glycol, and tetraethylene glycol), 1,2-propylene glycol, 1,3-propylene glycol, lower oligomers of propylene glycol (e.g., dipropylene glycol, tripropylene glycol, and tetrapropylene glycol), 1,4-butylene glycol, 2,3-butylene glycol, 1,6-hexanediol, 1,8-octanediol, neopentyl glycol, 1,4-cyclohexanedimethanol, 2-ethyl-1,6-hexanediol, 1-methyl-1,3-propanediol, 2-methyl-1,3-propanediol, dihydroxyalkylated aromatic compounds (e.g., bis (2-hydroxyethyl) ethers of hydroquinone and resorcinol, xylene-a,a-diols, bis(2-hydroxyethyl) ethers of xylene-a,a-diols, and combinations thereof).

Segment $R_2$ in Formula 1 and 2 can include a polyether group, a polyester group, a polycarbonate group, an aliphatic group, or an aromatic group. Each segment $R_2$ can be present in an amount of five percent to 85 percent by weight, from five percent to 70 percent by weight, or from ten percent to 50 percent by weight, based on the total weight of the reactant monomers.

Optionally, in some examples, the thermoplastic polyurethane elastomer is a thermoplastic polyurethane having a relatively high degree of hydrophilicity. For example, the thermoplastic polyurethane can be a thermoplastic polyether polyurethane in which segment $R_2$ in Formulas 1 and 2 includes a polyether group, a polyester group, a polycarbonate group, an aliphatic group, or an aromatic group, wherein the aliphatic group or aromatic group is substituted with one or more pendant groups having a relatively greater degree of hydrophilicity (i.e., relatively "hydrophilic" groups). The relatively "hydrophilic" groups can be selected from the group consisting of hydroxyl, polyether, polyester, polylactone (e.g., polyvinylpyrrolidone [PVP]), amino, carboxylate, sulfonate, phosphate, ammonium (e.g., tertiary and quaternary ammonium), zwitterion (e.g., a betaine, such as poly(carboxybetaine) (pCB), and ammonium phosphonates such as phosphatidylcholine), and combinations thereof. In such examples, this relatively hydrophilic group or segment of $R_2$ can form portions of the polyurethane backbone, or can be grafted to the polyurethane backbone as a pendant group. In some examples, the pendant hydrophilic group or segment can be bonded to the aliphatic group or aromatic group through a linker. Each segment $R_2$ can be present in an amount of five percent to 85 percent by weight, from five percent to 70 percent by weight, or from ten percent to 50 percent by weight, based on the total weight of the reactant monomers.

In some examples, at least one $R_2$ segment of the thermoplastic polyurethane elastomer includes a polyether segment (i.e., a segment having one or more ether groups). Suitable polyethers include, but are not limited to, polyethylene oxide (PEO), polypropylene oxide (PPO), polytetrahydrofuran (PTHF), polytetramethylene oxide (PTmO), and combinations thereof. The term "alkyl" as used herein refers to straight-chained and branched saturated hydrocarbon groups containing one to thirty carbon atoms, for example, one to twenty carbon atoms, or one to ten carbon atoms. The term $C_n$, means the alkyl group has "n" carbon atoms. For example, $C_4$ alkyl refers to an alkyl group that has four carbon atoms. $C_{1-7}$ alkyl refers to an alkyl group having a number of carbon atoms encompassing the entire range (i.e., one to seven carbon atoms), as well as all subgroups (e.g., 1-6, 2-7, 1-5, 3-6, 1, 2, 3, 4, 5, 6, and 7 carbon atoms). Non-limiting examples of alkyl groups include methyl, ethyl, n-propyl, isopropyl, n-butyl, sec-butyl (2-methylpropyl), t-butyl (1,1-dimethylethyl), 3,3-dimethylpentyl, and 2-ethylhexyl. Unless otherwise indicated, an alkyl group can be an unsubstituted alkyl group or a substituted alkyl group.

In some examples of the thermoplastic polyurethane elastomer, the at least one R2 segment includes a polyester segment. The polyester segment can be derived from the polyesterification of one or more dihydric alcohols (e.g., ethylene glycol, 1,3-propylene glycol, 1,2-propylene glycol, 1,4-butanediol, 1,3-butanediol, 2-methylpentanediol-1,5,diethylene glycol, 1,5-pentanediol, 1,5-hexanediol, 1,2-dodecanediol, cyclohexanedimethanol, and combinations thereof) with one or more dicarboxylic acids (e.g., adipic acid, succinic acid, sebacic acid, suberic acid, methyladipic acid, glutaric acid, pimelic acid, azelaic acid, thiodipropionic acid, citraconic acid, and combinations thereof). The polyester also can be derived from polycarbonate prepolymers, such as poly(hexamethylene carbonate) glycol, poly (propylene carbonate) glycol, poly(tetramethylene carbonate)glycol, and poly(nonanemethylene carbonate) glycol. Suitable polyesters can include, for example, polyethylene adipate (PEA), poly(1,4-butylene adipate), poly(tetramethylene adipate), poly(hexamethylene adipate), polycaprolactone, polyhexamethylene carbonate, poly(propylene carbonate), poly(tetramethylene carbonate), poly (nonanemethylene carbonate), and combinations thereof.

In various aspects of the thermoplastic polyurethane elastomer, at least one $R_2$ segment includes a polycarbonate segment. The polycarbonate segment can be derived from the reaction of one or more dihydric alcohols (e.g., ethylene glycol, 1,3-propylene glycol, 1,2-propylene glycol, 1,4-butanediol, 1,3-butanediol, 2-methylpentanediol-1,5, diethylene glycol, 1,5-pentanediol, 1,5-hexanediol, 1,2-dodecanediol, cyclohexanedimethanol, and combinations thereof) with ethylene carbonate.

In various examples of the thermoplastic polyurethane elastomer, at least one $R_2$ segment can include an aliphatic group substituted with one or more groups having a relatively greater degree of hydrophilicity, i.e., a relatively "hydrophilic" group. The one or more relatively hydrophilic group can be selected from the group consisting of hydroxyl, polyether, polyester, polylactone (e.g., polyvinylpyrrolidone), amino, carboxylate, sulfonate, phosphate, ammonium (e.g., tertiary and quaternary ammonium), zwitterion (e.g., a betaine, such as poly(carboxybetaine) (pCB), and ammonium phosphonates such as phosphatidylcholine), and combinations thereof. In some examples, the aliphatic group is linear and can include, for example, a $C_{1-20}$ alkylene chain or a $C_{1-20}$ alkenylene chain (e.g., methylene, ethylene, propylene, butylene, pentylene, hexylene, heptylene, octylene, nonylene, decylene, undecylene, dodecylene, tridecylene, ethenylene, propenylene, butenylene, pentenylene, hexenylene, heptenylene, octenylene, nonenylene, decenylene, undecenylene, dodecenylene, and tridecenylene). The term "alkylene" refers to a bivalent hydrocarbon. The term means that the alkylene group has "n" carbon atoms. For example, $C_{1-6}$ alkylene refers to an alkylene group having, e.g., one, two, three, four, five, or six carbon atoms. The term "alkenylene" refers to a bivalent hydrocarbon having at least one double bond.

In some cases, at least one $R_2$ segment includes an aromatic group substituted with one or more relatively hydrophilic group. The one or more hydrophilic groups can be selected from the group consisting of hydroxyl, polyether, polyester, polylactone (e.g., polyvinylpyrrolidone), amino, carboxylate, sulfonate, phosphate, ammonium (e.g., tertiary and quaternary ammonium), zwitterionic (e.g., a betaine, such as poly(carboxybetaine) (pCB), and ammonium phosphonate groups such as phosphatidylcholine), and combinations thereof. Suitable aromatic groups include, but are not limited to, phenyl, naphthyl, tetrahydronaphthyl, phenanthrenyl, biphenylenyl, indanyl, indenyl, anthracenyl, fluorenylpyridyl, pyrazinyl, pyrimidinyl, pyrrolyl, pyrazolyl, imidazolyl, thiazolyl, tetrazolyl, oxazolyl, isooxazolyl, thiadiazolyl, oxadiazolyl, furanyl, quinolinyl, isoquinolinyl, benzoxazolyl, benzimidazolyl, and benzothiazolyl groups, and combinations thereof.

In various aspects, the aliphatic and aromatic groups can be substituted with one or more relatively hydrophilic and/or charged pendant groups. In some aspects, the pendant hydrophilic group includes one or more (e.g., two, three, four, five, six, seven, eight, nine, ten, or more) hydroxyl groups. In various aspects, the pendant hydrophilic group includes one or more (e.g., two, three, four, five, six, seven, eight, nine, ten, or more) amino groups. In some cases, the pendant hydrophilic group includes one or more (e.g., two, three, four, five, six, seven, eight, nine, ten, or more) carboxylate groups. For example, the aliphatic group can include one or more polyacrylic acid groups. In some cases, the pendant hydrophilic group includes one or more (e.g., two, three, four, five, six, seven, eight, nine, ten, or more) sulfonate groups. In some cases, the pendant hydrophilic group includes one or more (e.g., two, three, four, five, six, seven, eight, nine, ten, or more) phosphate groups. In some examples, the pendant hydrophilic group includes one or more ammonium groups (e.g., tertiary and/or quaternary ammonium). In other examples, the pendant hydrophilic group includes one or more zwitterionic groups (e.g., a betaine, such as poly (carboxybetaine) (pCB), and ammonium phosphonate groups such as a phosphatidylcholine group).

In some aspects, the $R_2$ segment can include charged groups that are capable of binding to a counterion to ionically cross-link the thermoplastic elastomer and form ionomers. In these aspects, for example, $R_2$ is an aliphatic or aromatic group having pendant amino, carboxylate, sulfonate, phosphate, ammonium, or zwitterionic groups, or combinations thereof.

In various cases when a pendant hydrophilic group is present, the pendant "hydrophilic" group is at least one polyether group, such as two polyether groups. In other cases, the pendant hydrophilic group is at least one polyester. In various cases, the pendant hydrophilic group is a polylactone group (e.g., polyvinylpyrrolidone). Each carbon atom of the pendant hydrophilic group can optionally be substituted with, e.g., a $C_{1-6}$ alkyl group. In some of these aspects, the aliphatic and aromatic groups can be graft polymeric groups, wherein the pendant groups are homopolymeric groups (e.g., polyether groups, polyester groups, or polyvinylpyrrolidone groups).

In some aspects, the pendant hydrophilic group is a polyether group (e.g., a polyethylene oxide group or a polyethylene glycol group), a polyvinylpyrrolidone group, a polyacrylic acid group, or combinations thereof.

As described herein, the thermoplastic polyurethane elastomer can be physically cross-linked through, e.g., nonpolar or polar interactions between the urethane or carbamate groups on the polymers (the hard segments). In these aspects, component $R_1$ in Formula 1 and components $R_1$ and $R_3$ in Formula 2 form the portion of the polymer often referred to as the "hard segment," and component $R_2$ forms the portion of the polymer often referred to as the "soft segment." In these aspects, the soft segment can be covalently bonded to the hard segment. In some examples, the thermoplastic polyurethane elastomer having physically cross-linked hard and soft segments can be a hydrophilic thermoplastic polyurethane elastomer (i.e., a thermoplastic polyurethane elastomer including hydrophilic groups, as disclosed herein).

In one aspect, prior to thermoforming, the thermoplastic polyurethane elastomer is an aromatic polyester thermoplastic elastomeric polyurethane or an aliphatic polyester thermoplastic elastomeric polyurethane having the following properties: (1) a glass transition temperature of from about 20 degrees Celsius to about −60 degrees Celsius; (2) a Taber Abrasion Resistance of from about ten milligrams to about 40 milligrams, as determined by ASTM D3389; (3) a Durometer Hardness (Shore A) of from about 60 to about 90 as determined by ASTM D2240; (4) a specific gravity of from about 0.80 g/cm$^3$ to about 1.30 g/cm$^3$, as determined by ASTM D792; (5) a melt flow index of about two grams/ten minutes to about 50 grams/ten minutes at 160 degrees Celsius using a test weight of 2.16 kilograms; (6) a melt flow rate greater than about two grams/ten minutes at 190 degrees Celsius or 200 degrees Celsius when using a test weight of ten kilograms; and (7) a modulus of about one megapascal to about 500 megapascals.

Commercially available thermoplastic polyurethane elastomers having greater hydrophilicity suitable for the present use include, but are not limited to, those under the tradename "TECOPHILIC," such as TG-500, TG-2000, SP-80A-150, SP-93A-100, SP-60D60 (Lubrizol, Countryside, IL), "ESTANE" (e.g., 58238 and T470A; Lubrizol, Countryside, IL), and "ELASTOLLAN" (e.g., 9339, 1370A, and BASF).

In various aspects, the thermoplastic polyurethane elastomer can be partially covalently cross-linked, as previously described herein.

Example Thermoplastic Styrenic Copolymer Elastomers

In certain aspects, the thermoplastic elastomer is a thermoplastic elastomeric styrenic copolymer. Examples of these copolymers include, but are not limited to, styrene butadiene styrene (SBS) block copolymer, a styrene ethylene/butylene styrene (SEBS) resin, a polyacetal resin (POM) a styrene acrylonitrile resin (SAN), or a blend, alloy, or compound thereof. Exemplary commercially available thermoplastic elastomeric styrenic copolymers include MONOPRENE IN5074, SP066070, and SP16975 (Teknor Apex, Pawtucket, RI, USA), which are styrene ethylene/butylene styrene (SEBS) resins. In some aspects, blends, alloys, and compounds should be melt-compatible or can be compatibilized with additives, oils, or grafted chemical moieties in order to achieve miscibility.

In one aspect, the thermoplastic elastomeric styrenic copolymer includes at least one block as illustrated below in Formula 3:

(Formula 3)

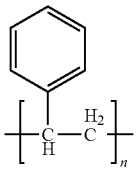

In another aspect, the thermoplastic elastomeric styrenic copolymer can be an SBS block copolymer comprising a first polystyrene block (block m of Formula 4), a polybutadiene block (block o of Formula 4), and a second polystyrene block (block p of Formula 4), wherein the SBS block copolymer has the general structure shown in Formula 4 below:

(Formula 4)

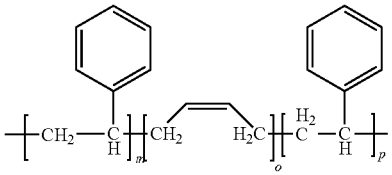

In another aspect, the thermoplastic elastomeric styrenic copolymer can be an SEBS block copolymer comprising a first polystyrene block (block x of Formula 5), a polyolefin block (block y of Formula 5), wherein the polyolefin block comprises alternating polyethylene blocks (block v of Formula 5) and polybutylene blocks (block w of Formula 4), and a second polystyrene block (block z of Formula 5) as seen in Formula 5 below:

(Formula 5)

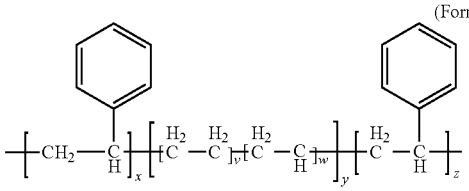

In one aspect, SEBS polymers have a density from about 0.88 grams per cubic centimeter to about 0.92 grams per cubic centimeter. In a further aspect, SEBS polymers can be as much as 15 to 25 percent less dense than cross-linked rubbers, cross-linked polyurethanes, and thermoplastic polyurethane materials. In a further aspect, a less dense coating composition offers weight savings and per part cost savings for the same material of volume employed while achieving similar performance.

Reference to "a chemical compound" refers to one or more molecules of the chemical compound, rather than being limited to a single molecule of the chemical compound. Furthermore, the one or more molecules can or cannot be identical, so long as they fall under the category of the chemical compound. Thus, for example, "a polyamide" is interpreted to include one or more polymer molecules of the polyamide, where the polymer molecules can or cannot be identical (e.g., different molecular weights and/or isomers).

The terms "at least one" and "one or more of" an element are used interchangeably, and have the same meaning that includes a single element and a plurality of the elements, and can also be represented by the suffix "(s)" at the end of the element. For example, "at least one polyamide," "one or more polyamides," and "polyamide(s)" can be used interchangeably and have the same meaning.

Unless otherwise specified, temperatures referred to herein are determined at standard atmospheric pressure (i.e., one ATM).

Property Analysis and Characterization Procedures

Evaluation of various properties and characteristics described herein are by various testing procedures, as described below.

Sample Coefficient of Friction. The static or dynamic COF of a textile or plaque sample can be determined using test method ASTM D1894. In this method, a sample is cut to size and mounted on the sled, and a 100 gram weight plate is placed on the sled. During the test, the weighted sled is pulled across a test surface of the material being tested. For example, static and dynamic or wet and dry COF may be determined by pulling the sled across a concrete surface to determine the COF of the sample and concrete. The COF of the sample against that surface is captured by recording the normal force (100 grams plus sled weight) and measuring the applied force required to drag the sled across the test surface. The COF is then calculated from the ratio of the two forces. Dry COF is determined by testing a dry sample against a dry testing surface, and wet COF is determined by testing a sample wetted with water by soaking it in room temperature water for ten minutes against a test surface wetted with room temperature water.

Textile-Ball Coefficient of Friction Test. The static and dynamic COF of a sample prepared using the Component Sampling Procedure or the Textile Sampling Procedure described below against a sample from a panel of a "MERLIN" football (Nike Inc., Beaverton, OR, USA) can be determined using a modified version of test method ASTM D1894 as described for the Sample Coefficient of Friction. In this method, the sample is cut to size and mounted on an acrylic substrate, and the ball material is cut to size and mounted on the sled. Once the ball material has been mounted on the sled, the sled has a contact footprint of 3.9 inches by one inch, and a weight of approximately 0.402 kilograms. During the test, the sample and ball material are positioned with the external-facing surface of the ball material contacting the surface of the sample which is intended form the exterior knit textile surface 613, and the sled is pulled across the sample. Dry samples and dry ball material are used to determine the static or dynamic dry COF. To determine the static or dynamic wet COF, the sample and the ball material are both soaked in room temperature water for ten minutes immediately prior to testing. Each measurement is repeated at least three times, and the results of the runs are averaged.

Melting and Glass Transition Temperature Test. The melting temperature and/or glass transition temperature are determined for a sample prepared according to Material Sampling Procedure described below, using a commercially available Differential Scanning Calorimeter ("DSC") in accordance with ASTM D3418-97. Briefly, a 10-60 milligram sample is placed into an aluminum DSC pan, and then the lid is sealed with a crimper press. The DSC is configured to scan from 100 degrees Celsius to 225 degrees Celsius with a 20 degree Celsius/minute heating rate, to hold at 225 degrees Celsius for two minutes, and then to cool down to 25 degrees Celsius at a rate of 20 degrees Celsius/minute. The DSC curve created from this scan is then analyzed using standard techniques to determine the glass transition temperature and the melting temperature. Melting enthalpy is calculated by integrating the melting endotherm and normalizing by the mass of the sample. Crystallization enthalpy upon cooling is calculated by integrating the cooling endotherm and normalizing by the mass of the sample.

Yarn Tenacity and Elongation Test. Tenacity and elongation of the yarn sample are determined according to the test method detailed in EN ISO 2062 with the pre-load set to five grams. Elongation is recorded at the maximum tensile force value applied prior to breaking. In some aspects, tenacity is calculated as the ratio of load required to break the specimen to the linear density of the specimen.

Durometer Hardness Test. The hardness of a material can be determined for a sample according to the test method detailed in ASTM D-2240 Durometer Hardness using a Shore A scale.

Sampling Procedures

Using the Tests described above, various properties of the materials disclosed herein and articles formed therefrom can be characterized using samples prepared with the following sampling procedures:

Component Sampling Procedure. This procedure can be used to obtain a sample of a material from a component of an article of footwear, an article of footwear, a component of an article of apparel, an article of apparel, a component of an article of sporting equipment, or an article of sporting equipment, including a sample of a polymeric composition or of a textile, or a portion of a textile, such as a thermoformed network. A sample including the material in a non-wet state (e.g., at 25 degrees Celsius and 20 percent relative humidity) is cut from the article or component using a blade. If the material is bonded to one or more additional materials, the procedure can include separating the additional materials from the material to be tested. For example, to test a material on a ground-facing surface of a sole structure, the opposite surface can be skinned, abraded, scraped, or otherwise cleaned to remove any adhesives, yarns, fibers, foams, and the like, which are affixed to the material to be tested. The resulting sample includes the material and not any additional materials bonded to the material.

The sample is taken at a location along the article or component that provides a substantially constant material thickness for the material as present on the article or component (within plus or minus ten percent of the average material thickness) For many of the test protocols described above, a sample having a surface area of four square centimeters ($cm^2$) is used. The sample is cut into a size and shape (e.g., a dog-bone-shaped sample) to fit into the testing apparatus. In cases where the material is not present on the article or component in any segment having a four square centimeter surface area, and/or where the material thickness is not substantially constant for a segment having a four square centimeter surface area, sample sizes with smaller cross-sectional surface areas can be taken, and the area-specific measurements are adjusted accordingly.

Textile Sampling Procedure. A textile to be tested is stored at room temperature (20 degrees Celsius to 24 degrees Celsius) for 24 hours prior to testing. The textile sample is cut to size, as dictated by the test method to be used, with minimal tension at approximately room temperature (e.g., 20 degrees Celsius).

What is claimed is:

1. A goal keeper athletic glove, comprising:

a palmar side, comprising a distal palmar portion having a lower edge, a proximal palmar portion having an upper edge, and a palmar seam joining the lower edge of the distal palmar portion and the upper edge of the proximal palmar portion;

a dorsal side, comprising a distal dorsal portion having a lower edge, a proximal dorsal portion having an upper edge, and a dorsal seam joining the lower edge of the distal dorsal portion and the upper edge of the proximal dorsal portion; and the distal palmar portion has a first coefficient of friction, the distal dorsal portion has a second coefficient of friction, and the proximal dorsal portion has a third coefficient of friction, the third coefficient of friction being less than the first coefficient of friction and less than the second coefficient of friction, wherein the distal dorsal portion comprises three layers, including an interior textile layer, a medial layer, and an exterior knit textile layer.

2. The athletic glove of claim 1, wherein the exterior knit textile layer comprises a thermoformed network of interlooped yarns.

3. The athletic glove of claim 2, wherein the thermoformed network of interlooped yarns comprises a first yarn having a core and a coating, the coating at least partially surrounding the core, and wherein the coating interconnects the thermoformed network of interlooped yarns by surrounding at least a portion of the core and occupying at least a portion of spaces between yarns in the thermoformed network of interlooped yarns.

4. The athletic glove of claim 1, wherein an exterior knit textile surface of the exterior knit textile layer forms an outer surface of the athletic glove.

5. The athletic glove of claim 1, wherein the medial layer comprises a polymeric foam composition and the medial layer further comprises an exterior surface, wherein the exterior surface comprises ridges.

6. The athletic glove of claim 1, wherein the distal palmar portion comprises latex foam.

7. The athletic glove of claim 1, wherein the proximal palmar portion and the proximal dorsal portion comprise a textile.

8. A method of manufacturing a goal keeper athletic glove, the method comprising:

forming a dorsal side, including a distal dorsal portion having a lower edge, a proximal dorsal portion having an upper edge, and a dorsal seam joining the lower edge of the distal dorsal portion and the upper edge of the proximal dorsal portion, wherein the distal dorsal portion comprises three layers, including an interior textile layer, a medial layer, and an exterior knit textile layer;

forming a palmar side, including a distal palmar portion having a lower edge, a proximal palmar portion having an upper edge, and a palmar seam joining the lower edge of the distal palmar portion and the upper edge of the palmar portion, wherein the distal palmar portion comprises a foam layer; and wherein the distal palmar portion has a first coefficient of friction, the distal dorsal portion has a second coefficient of friction, the proximal dorsal portion has a third coefficient of friction, the third coefficient of friction being less than the first coefficient of friction and the second coefficient of friction.

9. The method of manufacturing a goal keeper athletic glove of claim 8, wherein the proximal palmar portion and the proximal dorsal portion comprise a textile.

10. The method of manufacturing a goal keeper athletic glove of claim 8, further comprising forming the goal keeper athletic glove such that an exterior surface of the exterior knit textile layer forms an outer surface of the goal keeper athletic glove.

11. The method of manufacturing a goal keeper athletic glove of claim 8, wherein the exterior knit textile layer comprises a first yarn, the first yarn comprising a first core yarn and a first coating.

12. The method of manufacturing a goal keeper athletic glove of claim 11, wherein the exterior knit textile layer comprises a second yarn, the second having a different material composition than a material composition of the first yarn.

13. The method of manufacturing a goal keeper athletic glove of claim 12, wherein the exterior knit textile layer comprises a thermoformed network of interlooped yarns, each of the interlooped yarns having a core, such that a thermoplastic elastomer interconnects the interlooped yarns by surrounding at least a portion of each core and occupying at least a portion of spaces between yarns in the thermoformed network of interlooped yarns.

14. The method of manufacturing a goal keeper athletic glove of claim 8, wherein the medial layer comprises a polymeric foam composition forming an exterior surface, and wherein the exterior surface comprises ridges.

* * * * *